US010556768B2

(12) United States Patent
Arai et al.

(10) Patent No.: US 10,556,768 B2
(45) Date of Patent: Feb. 11, 2020

(54) POST-PROCESSING APPARATUS, CONTROL METHOD THEREFOR, AND NON-TRANSITORY COMPUTER-READABLE STORAGE MEDIUM

(71) Applicant: CANON KABUSHIKI KAISHA, Tokyo (JP)

(72) Inventors: Akihiro Arai, Toride (JP); Akinobu Nishikata, Matsudo (JP); Takashi Yokoya, Yoshikawa (JP); Yutaka Ando, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/215,775

(22) Filed: Dec. 11, 2018

(65) Prior Publication Data

US 2019/0185286 A1 Jun. 20, 2019

(30) Foreign Application Priority Data

Dec. 14, 2017 (JP) ..... 2017-239817

(51) Int. Cl.
*B65H 43/08* (2006.01)
*B65H 39/06* (2006.01)
*B65H 31/34* (2006.01)

(52) U.S. Cl.
CPC ..... *B65H 43/08* (2013.01); *B65H 31/34* (2013.01); *B65H 39/06* (2013.01); *B65H 2553/41* (2013.01); *B65H 2701/1712* (2013.01)

(58) Field of Classification Search
CPC ..... B65H 31/34; B65H 39/06; B65H 43/08; B65H 2553/41; B65H 2701/1712
USPC ..... 270/58.04
See application file for complete search history.

(56) References Cited

U.S. PATENT DOCUMENTS

| | | | | |
|---|---|---|---|---|
| RE28,660 | E * | 12/1975 | Pettet | B65H 7/125 271/263 |
| 8,393,372 | B2 | 3/2013 | Yamauchi et al. | |
| 8,413,978 | B2 | 4/2013 | Watanabe et al. | |
| 8,628,073 | B2 | 1/2014 | Watanabe et al. | |
| 9,602,690 | B2 | 3/2017 | Yokoyama et al. | |
| 9,868,603 | B2 * | 1/2018 | Ando | G03G 15/6541 |
| 10,059,557 | B2 | 8/2018 | Yokoya et al. | |

FOREIGN PATENT DOCUMENTS

| | | | | |
|---|---|---|---|---|
| JP | 2006-151551 A | | 6/2006 | |
| JP | 2017024888 A | * | 2/2017 | G03G 15/6541 |

* cited by examiner

*Primary Examiner* — Leslie A Nicholson, III
(74) *Attorney, Agent, or Firm* — Venable LLP

(57) ABSTRACT

A post-processing apparatus connectable to an image forming apparatus which performs a post-processing on a sheet of a first type in a first post-processing mode, and performs the post-processing on a sheet of a second type having a light transmittance higher than the first type in a second post-processing mode, wherein, in a case where a job for performing the post-processing on a sheet of a third type is executed, the post-processing apparatus determines whether the sheet of the third type is detectable by the sheet detecting unit, operates in the first post-processing mode when the sheet of the third type is determined to be detectable by the sheet detecting unit, and operates in the second post-processing mode when the sheet of the third type is determined to be undetectable by the sheet detecting unit.

17 Claims, 17 Drawing Sheets

FIG. 7A

| |
|---|
| SHEET ID |
| SHEET WIDTH [mm] |
| SHEET LENGTH [mm] |
| BASIS WEIGHT [gsm] |
| SHEET TYPE |
| POST-PROCESSING MODE |
| BUNDLE LEADING SHEET / BUNDLE LAST SHEET INFORMATION |
| JOB LEADING SHEET / LAST SHEET INFORMATION |

FIG. 7B

| |
|---|
| SHEET ID |
| SHEET WIDTH [mm] |
| SHEET LENGTH [mm] |
| BASIS WEIGHT [gsm] |
| SHEET TYPE |
| SHEET BRAND NAME |
| POST-PROCESSING MODE |
| BUNDLE LEADING SHEET / BUNDLE LAST SHEET INFORMATION |
| JOB LEADING SHEET / LAST SHEET INFORMATION |

FIG. 14

| SENSOR-UNDETECTABLE TRANSLUCENT SHEET PAGE INFORMATION |
| --- |
| 3 |
| 7 |
| - |
| - |
| ⋮ |

FIG. 15

| BRAND NAME | DETERMINATION |
| --- | --- |
| BRAND NAME A | ○ |
| BRAND NAME B | ○ |
| BRAND NAME C | × |
| | |

⋮

POST-PROCESSING APPARATUS, CONTROL METHOD THEREFOR, AND NON-TRANSITORY COMPUTER-READABLE STORAGE MEDIUM

BACKGROUND OF THE INVENTION

Field of the Invention

The present invention relates to a sheet post-processing apparatus included in an image forming system.

Description of the Related Art

A copying machine, a printer, or other such image forming apparatus is widely known to be accompanied with a sheet post-processing apparatus, which is arranged on downstream of the image forming apparatus, and is configured to subject sheets output from the image forming apparatus to post-processing including alignment in a width direction of the sheet and staple binding. Such a sheet post-processing apparatus is also known to perform the post-processing including conveyance on not only a normal sheet but also a transparent sheet having a high transmittance for an overhead projector (OHP) or other such purpose.

When the staple binding or other such post-processing is performed, sheets are required to be aligned in the width direction, and hence alignment members are caused to operate in synchronization with the conveyance of each of the sheets. To that end, there has been devised an apparatus configured to use a light reflective sensor to perform the conveyance and the post-processing through use of a method of improving sheet position detection accuracy for a transparent sheet for an OHP or other such purpose (Japanese Patent Application Laid-Open No. 2006-151551).

However, a light reflective sensor has limited sheet detection accuracy, and causes misalignment or other such defect to occur unless the sheet detection accuracy is high enough. Therefore, in a spot that requires high sheet detection accuracy, it is known to use a light transmissive sensor to perform control. However, it is difficult for the light transmissive sensor to detect a transparent sheet, and this may cause a paper jam.

An apparatus using the light transmissive sensor may also employ a method of performing conveyance control based on a conveying speed and time without using the light transmissive sensor in a case of a transparent sheet. However, this method is unsatisfactory in terms of the sheet position detection accuracy, and requires much time for alignment control or other such post-processing. It is also required to provide a margin at a position of the alignment member, and this causes a decrease in productivity.

Although not so often as in the case of the transparent sheet, a translucent sheet having a high transmittance may be subjected to the post-processing as well. The translucent sheet has a different transmittance depending on a brand name, and hence some translucent sheets can be detected by the light transmissive sensor, while some cannot. Therefore, it is unknown whether or not the translucent sheet being used can be detected by the light transmissive sensor before the post-processing is actually performed thereon, which leads to a problem of causing a paper jam.

SUMMARY OF THE INVENTION

According to one embodiment of the present invention, a post-processing apparatus to be connected to an image forming apparatus comprises:

a sheet conveying unit configured to convey a sheet received from the image forming apparatus;

a sheet detecting unit, which is arranged in a conveyance path of the sheet conveying unit, and is configured to detect the sheet; and a post-processing unit configured to perform a post-processing on the sheet conveyed by the sheet conveying unit, wherein the post-processing apparatus is configured to:

perform the post-processing on a sheet of a first type in a first post-processing mode; and perform the post-processing on a sheet of a second type having a light transmittance higher than a light transmittance of the sheet of the first type in a second post-processing mode, which is different from the first post-processing mode in conveyance control of the sheet conveying unit, and wherein, in a case in which a job for performing the post-processing on a sheet of a third type different in type from the sheet of the first type and the sheet of the second type is executed, the post-processing apparatus is configured to:

determine whether the sheet of the third type is detectable by the sheet detecting unit;

operate in the first post-processing mode when it is determined that the sheet of the third type is detectable by the sheet detecting unit; and operate in the second post-processing mode when it is determined that the sheet of the third type is undetectable by the sheet detecting unit.

Further features of the present invention will become apparent from the following description of exemplary embodiments with reference to the attached drawings.

BRIEF DESCRIPTION OF THE DRAWINGS

FIG. 7A and FIG. 7B are diagrams for each illustrating a sheet information format.

FIG. 14 is a diagram for illustrating sensor-undetectable translucent sheet page information.

FIG. 15 is a diagram for illustrating a sensor-undetectable translucent sheet determination list.

DESCRIPTION OF THE EMBODIMENTS

First Embodiment

Figure 1:
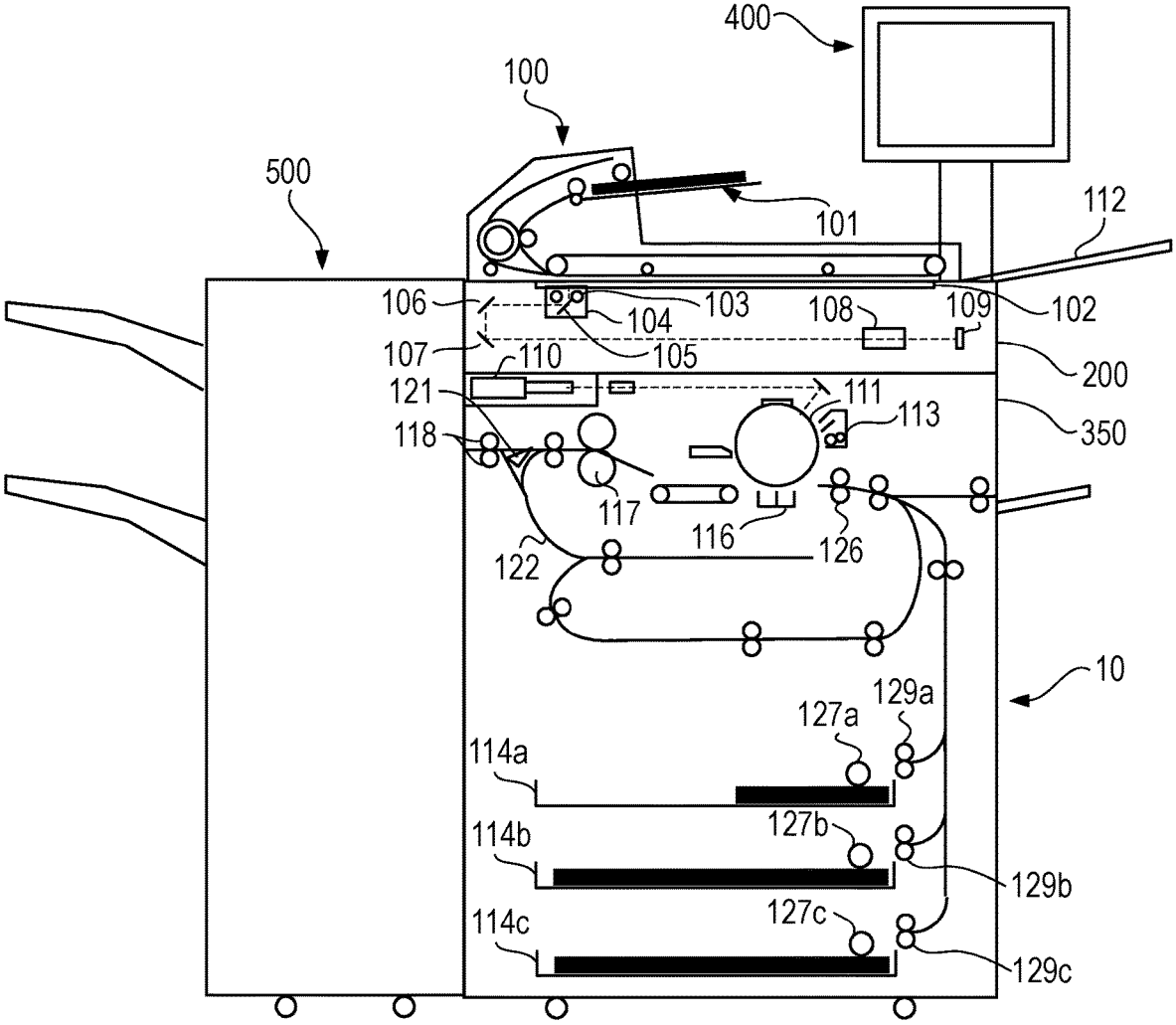
FIG. 1 is a diagram for illustrating an image forming system in a first embodiment of the present invention.

FIG. 1 is a configuration diagram for illustrating a vertical-sectional structure of a main part of an image forming system in a first embodiment of the present invention. As illustrated in FIG. 1, the image forming system is formed of an image forming apparatus 10 and a post-processing apparatus 500. The image forming apparatus 10 includes an image reader 200 configured to read an image from an original, a printer 350 configured to form the read image on a sheet, and an operation display device 400.

An original feeder 100 feeds originals set to face up on an original tray 101 in order from the top page one by one in the leftward direction of FIG. 1, and passes the fed original along a curved path to convey the original on a platen glass plate 102 from the left to the right through a predetermined flow reading position. After that, the original feeder 100 discharges the original to an outside discharge tray 112.

The flow reading position represents a predetermined reading position on the platen glass plate 102 included in the image reader 200, at which a scanner unit 104 is fixed. When the original passes from the left to the right through the flow reading position on the platen glass plate 102, an original image is read from the original by the scanner unit 104 held at a position corresponding to the flow reading position.

When the original passes through the flow reading position, a reading surface of the original is irradiated with light emitted from a lamp 103 of the scanner unit 104, and the light reflected by the original is guided to a lens 108 via mirrors 105, 106, and 107. The light passing through the lens 108 is imaged on an image pickup surface of an image sensor 109.

In this manner, the original is conveyed so as to pass from the left to the right through the flow reading position, to thereby perform original reading scanning with a direction perpendicular to a conveying direction of the original being set as a main scanning direction and with the conveying direction being set as a sub-scanning direction. That is, when passing through the flow reading position, the original is conveyed in the sub-scanning direction while being read line by line in the main scanning direction by the image sensor 109, to thereby have its entire surface read. The optically read image is converted into image data by the image sensor 109 to be output. The image data output from the image sensor 109 is input to an exposure portion 110 of the printer 350 as a video signal.

It is also possible to read the original by conveying the original onto the platen glass plate 102 by the original feeder 100 so as to stop at a predetermined position, and scanning the scanner unit 104 from the left to the right while the original is stopped. This reading method is referred to as so-called "original fixed reading".

In order to read an original without using the original feeder 100, the user first lifts the original feeder 100 to place the original on the platen glass plate 102. Then, the scanner unit 104 is scanned from the left to the right, to thereby read the original. That is, the original fixed reading is performed when the original is read without using the original feeder 100.

The exposure portion 110 of the printer 350 modulates a laser beam based on the video signal input from the image reader 200 to output the modulated laser beam. The laser beam is applied onto a photosensitive drum 111 while being scanned by a polygon mirror (not shown). On the photosensitive drum 111, an electrostatic latent image corresponding to the scanned laser beam is formed. In this case, at the time of the original fixed reading, the exposure portion 110 outputs the laser beam so as to form an erect image (image that is not a mirror image). The electrostatic latent image on the photosensitive drum 111 is converted into a visible image as a developer image with a developer supplied from a developing device 113.

Figure 3:
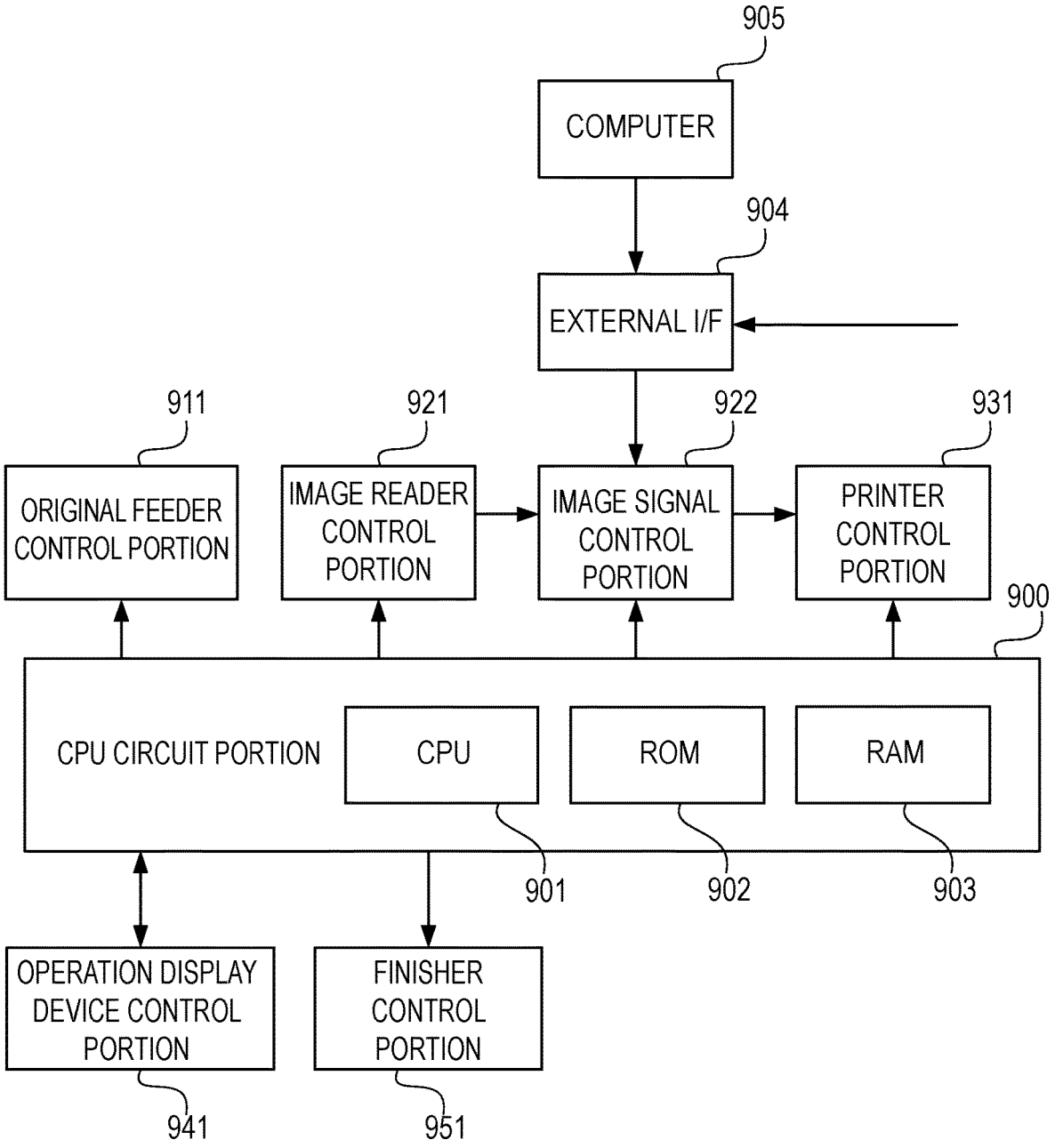
FIG. 3 is a system block diagram.

Instead of being a physical original, the original can also be transmitted as image data from, for example, a PC (computer 905 illustrated in FIG. 3). In this case, the image data is transmitted to a printer control portion 931 via an image signal control portion 922.

Meanwhile, a sheet fed by a pickup roller 127*a*, 127*b*, or 127*c* from a first cassette 114*a*, a second cassette 114*b*, or a third cassette 114*c*, which are mounted in the printer 350, is conveyed to registration rollers 126 by sheet feeding rollers 129*a*, 129*b*, or 129*c*. For example, normal sheets are contained in the first cassette 114*a*, transparent sheets are contained in the second cassette 114*b*, and translucent sheets are contained in the third cassette 114*c*. In the first embodiment, the normal sheet is an example of a sheet of a first type having a low light transmittance, the transparent sheet is an example of a sheet of a second type having a light transmittance higher than that of the normal sheet, and the translucent sheet is an example of a sheet of a third type having a light transmittance between those of the normal sheet and the transparent sheet.

When the sheet reaches the registration rollers 126, the post-processing apparatus 500 is notified of sheet information on the sheet via a communication IC, which is described later. The sheet information includes a sheet size, a basis weight, a sheet material type, and a post-processing mode. FIG. 7A and FIG. 7B are diagrams for each illustrating a format of the sheet information to be transmitted by the image forming apparatus 10.

When the original is to be read, the sheet information is transmitted to a CPU circuit portion 900 together with the read image data by, for example, the user designating a print setting through the operation display device 400. Meanwhile, when the image data is to be transmitted from the computer 905 to the CPU circuit portion 900, the sheet information can also be transmitted from the computer 905 to the CPU circuit portion 900 together with the image data.

Then, the registration rollers 126 is driven at a freely-set timing to convey the sheet to a position between the photosensitive drum 111 and a transfer portion 116. The developer image formed on the photosensitive drum 111 is transferred onto the fed sheet by the transfer portion 116. The sheet onto which the developer image has been transferred is conveyed to a fixing portion 117. The fixing portion 117 heats and pressurizes the sheet to fix the developer image onto the sheet. The sheet that has passed through the fixing portion 117 is caused to pass through a flapper 121 and discharge rollers 118 to be discharged from the printer 350 toward the post-processing apparatus 500.

In this case, in order to be discharged with its image formation surface facing downward (facing down), the sheet that has passed through the fixing portion 117 is temporarily guided into a reverse path 122 by a switching operation of the flapper 121. After a trailing edge of the sheet has passed through the flapper 121, the sheet is caused to switch back to be discharged from the printer 350 by the discharge rollers 118. This discharging form is referred to as "surface reverse discharge". The surface reverse discharge is performed when images are to be formed in order from the top page, for example, when the images read through use of the original feeder 100 are to be formed or when the images output from the computer 905 are to be formed. This enables the order of sheets after the discharge to become a correct order.

The sheets discharged from the printer 350 of the image forming apparatus 10 are sent to the post-processing apparatus 500. A configuration of the post-processing apparatus 500 is described later.

Next, a configuration of a controller configured to administer the control of the entire image forming system and the entire system blocks are described with reference to a block diagram of FIG. 3. FIG. 3 is the block diagram for illustrating the configuration of the controller configured to control the entire image forming system illustrated in FIG. 1.

As illustrated in FIG. 3, the controller includes the CPU circuit portion 900, and a CPU 901, a ROM 902, and a RAM 903 are built into the CPU circuit portion 900. The CPU 901 performs basic control of the entire image forming system. The CPU 901 is connected to each of the ROM 902, to which a control program has been written, and the RAM 903 to be used for performing processing via an address bus and a data bus. The CPU 901 uses the control program stored in the ROM 902 to centrally control respective control portions including an original feeder control portion 911, an image reader control portion 921, the image signal control portion 922, an external interface (hereinafter referred to as "external I/F") 904, the printer control portion 931, an operation display device control portion 941, and a finisher control portion 951. The RAM 903 temporarily holds control data, and is also used as a work memory for arithmetic operation processing involved in the control.

The original feeder control portion 911 performs control to drive the original feeder 100 based on an instruction issued from the CPU circuit portion 900. The image reader control portion 921 performs control to drive the scanner unit 104, the image sensor 109, and other such components described above, to thereby transfer the image signal output from the image sensor 109 to the image signal control portion 922.

The image signal control portion 922 converts an analog image signal from the image sensor 109 into a digital signal, then subjects the digital signal to each of different kinds of processing, converts the digital signal into a video signal, and outputs the video signal to the printer control portion 931. In another case, the image signal control portion 922 performs different kinds of processing on a digital image signal input from the computer 905 via the external I/F 904, converts the digital image signal into a video signal, and outputs the video signal to the printer control portion 931. This processing operation performed by the image signal control portion 922 is controlled by the CPU circuit portion 900.

The printer control portion 931 controls the exposure portion 110 and the printer 350 to perform image formation and sheet conveyance based on the input video signal. The finisher control portion 951 is mounted to the post-processing apparatus 500, and exchanges information with the CPU circuit portion 900, to thereby perform control to drive the entire post-processing apparatus 500. This control is described later in detail.

The operation display device control portion 941 exchanges information between the operation display device 400 and the CPU circuit portion 900. The operation display device 400 includes a plurality of keys for setting different kinds of functions relating to the image formation and a display portion for displaying information indicating a setting status. The operation display device control portion 941 outputs a key signal corresponding to an operation performed through each key to the CPU circuit portion 900, and displays information corresponding to a signal from the CPU circuit portion 900 on the operation display device 400.

Figure 2:
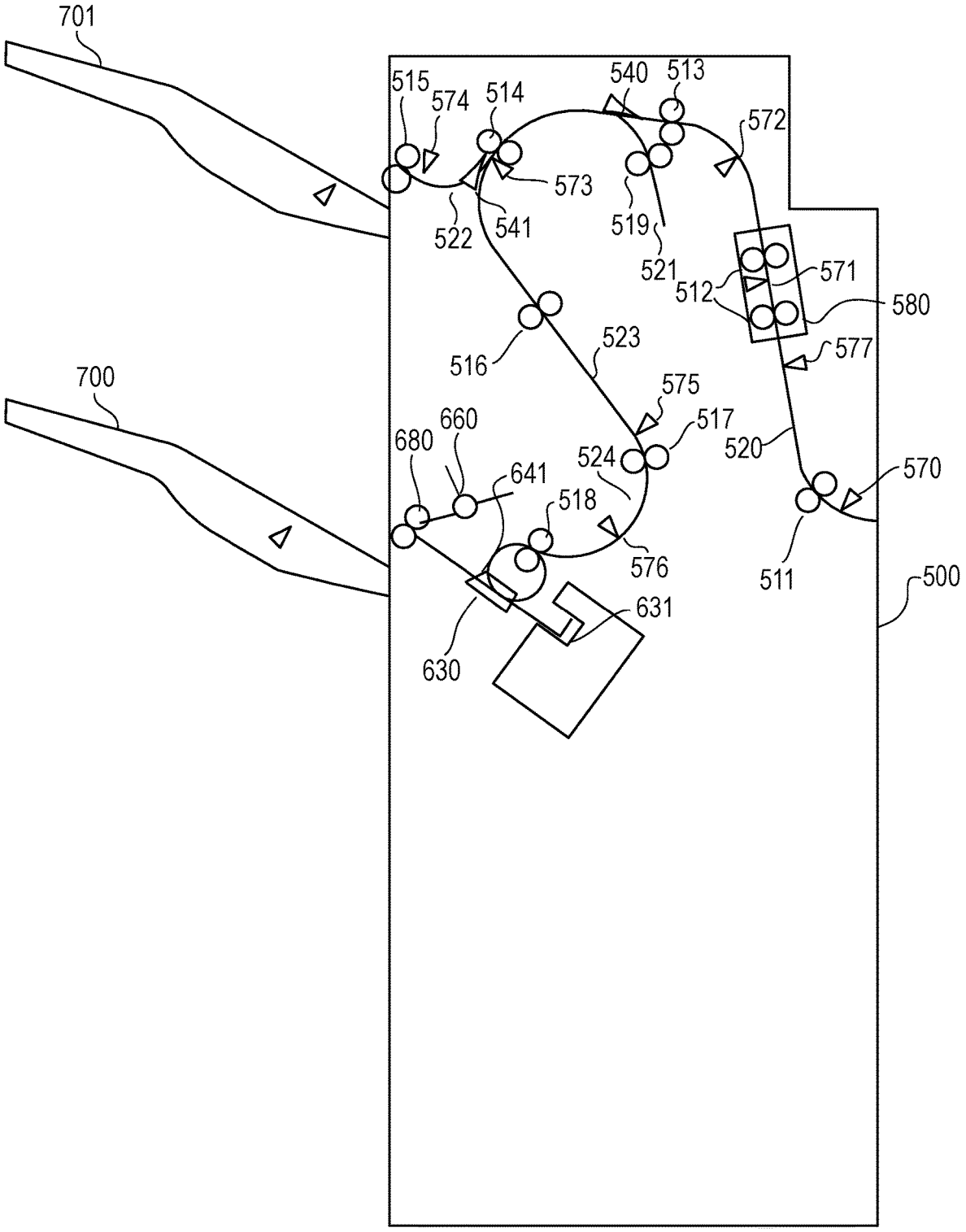
FIG. 2 is a sectional view of a post-processing apparatus (finisher).
Figure 4:
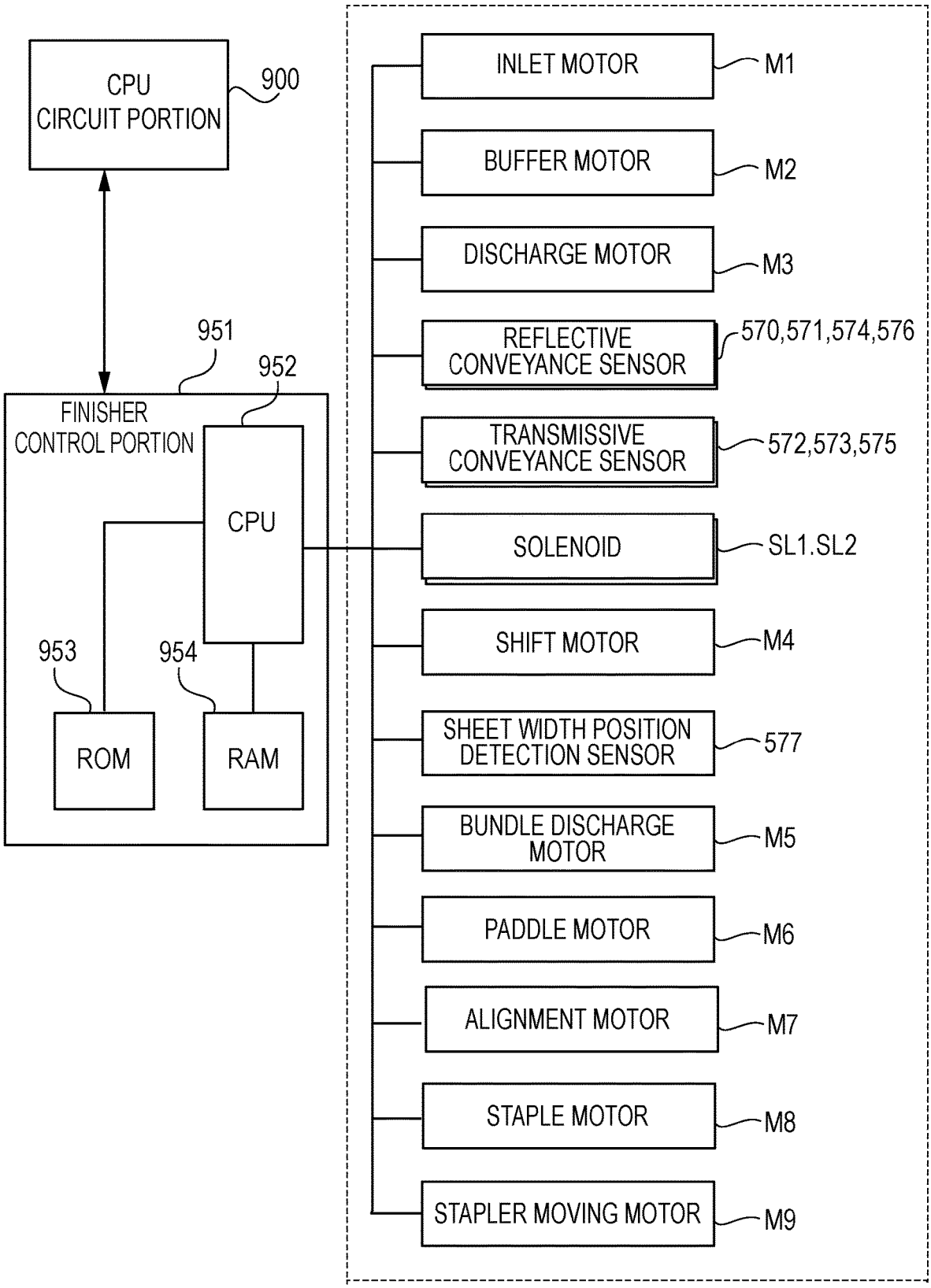
FIG. 4 is a block diagram of the post-processing apparatus.

Next, a configuration of the post-processing apparatus (hereinafter also referred to as "finisher") 500 is described with reference to FIG. 2 and FIG. 4. FIG. 2 is a configuration diagram for illustrating the post-processing apparatus 500, and FIG. 4 is a block diagram of the finisher control portion 951 configured to perform control to drive the post-processing apparatus 500. The post-processing apparatus 500 performs conveyance of the sheet in consideration of a sheet interval time, and as post-processing, performs an alignment process for the sheets in a sheet width direction perpendicular to the conveying direction and a stapling process for the sheets.

First, the description is given with reference to FIG. 2. The post-processing apparatus 500 takes in a plurality of sheets discharged from the image forming apparatus 10 in order. Then, the sheets are subjected to different kinds of post-processing including a process for aligning the plurality of sheets that have been taken in and bundling the sheets into one bundle and the stapling process for binding the trailing edges of the sheet bundle obtained through the bundling with staples.

The post-processing apparatus 500 takes the sheet discharged from the image forming apparatus 10 into a conveyance path 520 by a conveyance roller pair 511. The sheet taken into the inside by the conveyance roller pair 511 is sent via conveyance roller pairs 512 and 513. Conveyance sensors 570, 571, and 572 are provided on the conveyance path 520, and each detect the passage of the sheet therethrough.

A sheet width position sensing sensor 577 detects a position of an edge portion of the sheet being conveyed, and measures a deviation amount from a center position of the conveyance path 520. The measured deviation amount is used as a correction value of an offset position, which is described later.

The conveyance roller pairs 512 are provided in a shift unit 580 along with the conveyance sensor 571. The shift unit 580 is allowed to move in the sheet width direction perpendicular to the conveying direction by a shift motor M4 described later. The shift unit 580 can offset the sheet in its width direction while conveying the sheet by driving the shift motor M4 with the conveyance roller pairs 512 nipping the sheet.

When the user designates "shift" through the operation display device 400 illustrated in FIG. 1, the sheet in a front shift is offset by 15 mm toward a front side, and the sheet in a back shift is offset by 15 mm toward a back side. When the "shift" is not designated, the sheet passes through the shift unit 580 without being offset.

When the sheet is detected to have passed through the shift unit 580 based on input from the conveyance sensor 571, a CPU 952 drives the shift motor M4 to return the shift unit 580 to a center position.

A switching flapper 540 configured to guide the sheet reversely conveyed by a conveyance roller pair 514 to a buffer path 521 is arranged between the conveyance roller pairs 513 and 514. A switching flapper 541 configured to switch a destination of the sheet between an upper discharge path 522 and a lower conveying path 523 is arranged between the conveyance roller pair 514 and a conveyance roller pair 515.

When the switching flapper 541 is switched to the upper discharge path 522 side, the sheet is guided to the upper discharge path 522 by the conveyance roller pair 514 driven by a buffer motor M2 described later. Then, the sheet is discharged to a stack tray 701 by the conveyance roller pair 515 driven by a discharge motor M3 described later. A conveyance sensor 574 is provided on the upper discharge path 522, and detects the passage of the sheet therethrough.

Meanwhile, when the switching flapper 541 is switched to the lower conveyance path 523 side, the sheet is guided to the lower conveyance path 523 by the conveyance roller pair 514 driven by the buffer motor M2. Then, the sheet is conveyed by a conveyance roller pair 516 driven by the discharge motor M3. A conveyance sensor 575 is provided on the lower conveyance path 523, and detects the passage of the sheet therethrough.

A lower discharge path 524 is arranged downstream of the lower conveyance path 523, and the sheet is guided to a process tray 630 by conveyance roller pairs 517 and 518 driven by the discharge motor M3 described later. A conveyance sensor 576 is provided on the lower discharge path 524, and detects the passage of the sheet therethrough.

The sheet is discharged onto the process tray 630 or onto a stack tray 700 depending on the setting of the post-processing selected by the user through the operation display device 400.

When the user designates "staple", the sheet is discharged to the process tray 630. When the "staple" is not designated, the sheet is discharged to the stack tray 700 by a bundle discharge roller pair 680 driven by a bundle discharge motor M5 described later.

Alignment members 641 are provided in the vicinity of a part in which the process tray 630 is provided. The alignment members 641 are formed of a pair of members arranged so as to cross the conveying direction of the sheet, and aligns the sheet, which is conveyed along the lower discharge path 524, in the width direction. An operation of the alignment members 641 is described later.

Next, the finisher control portion 951 configured to perform control to drive the post-processing apparatus 500 is described with reference to FIG. 4. FIG. 4 is the block diagram for illustrating a configuration of the finisher control portion 951 illustrated in FIG. 3.

As illustrated in FIG. 4, the finisher control portion 951 includes the CPU 952, a ROM 953, and a RAM 954. The finisher control portion 951 communicates to/from the CPU circuit portion 900 provided to the image forming apparatus main body 10 via the communication IC (not shown) to exchange data with the CPU circuit portion 900. The finisher control portion 951 performs control to drive the post-processing apparatus 500 by executing each of different kinds of programs stored in the ROM 953 based on an instruction issued from the CPU circuit portion 900.

The finisher control portion 951 includes, in relation to different kinds of input/output, an inlet motor M1, the buffer motor M2, the discharge motor M3, the shift motor M4, and solenoids SL1 and SL2. The inlet motor M1 drives the conveyance roller pairs 511, 512, and 513. The buffer motor M2 drives the conveyance roller pair 514 and a conveyance roller pair 519. The discharge motor M3 drives the conveyance roller pairs 515, 516, 517, and 518. The shift motor M4 drives the shift unit 580. The solenoids SL1 and SL2 drive the switching flappers 540 and 541.

In addition, the finisher control portion 951 includes, as devices configured to drive different kinds of members of the process tray 630, the bundle discharge motor M5, a paddle motor M6, an alignment motor M7, a staple motor M8, and a stapler moving motor M9. The bundle discharge motor M5 drives the bundle discharge roller pair 680, the paddle motor M6 drives a paddle 660, and the alignment motor M7 drives the alignment members 641. The staple motor M8 drives a stapler 631 configured to perform a binding process on a sheet bundle. The stapler moving motor M9 moves the stapler 631 along an outer periphery of the process tray 630 in a direction perpendicular to the conveying direction.

In addition, light reflective conveyance sensors 570, 571, 574, and 576 and light transmissive conveyance sensors 572, 573, and 575 are arranged in a conveyance path in order to detect the passage of the sheet.

The light reflective conveyance sensors 570, 571, 574, and 576 can detect even a transparent sheet or other such sheet having a high light transmittance. Meanwhile, the light transmissive conveyance sensors 572, 573, and 575 are high in sheet position detection accuracy, and have a high ability to detect a normal sheet or other such sheet having a low light transmittance, while having a low ability to detect a transparent sheet or other such sheet having a high light transmittance. Therefore, as described later, the use of the light transmissive conveyance sensors 572, 573, and 575 allows distinction between sheets having different light transmittances.

Figure 5:
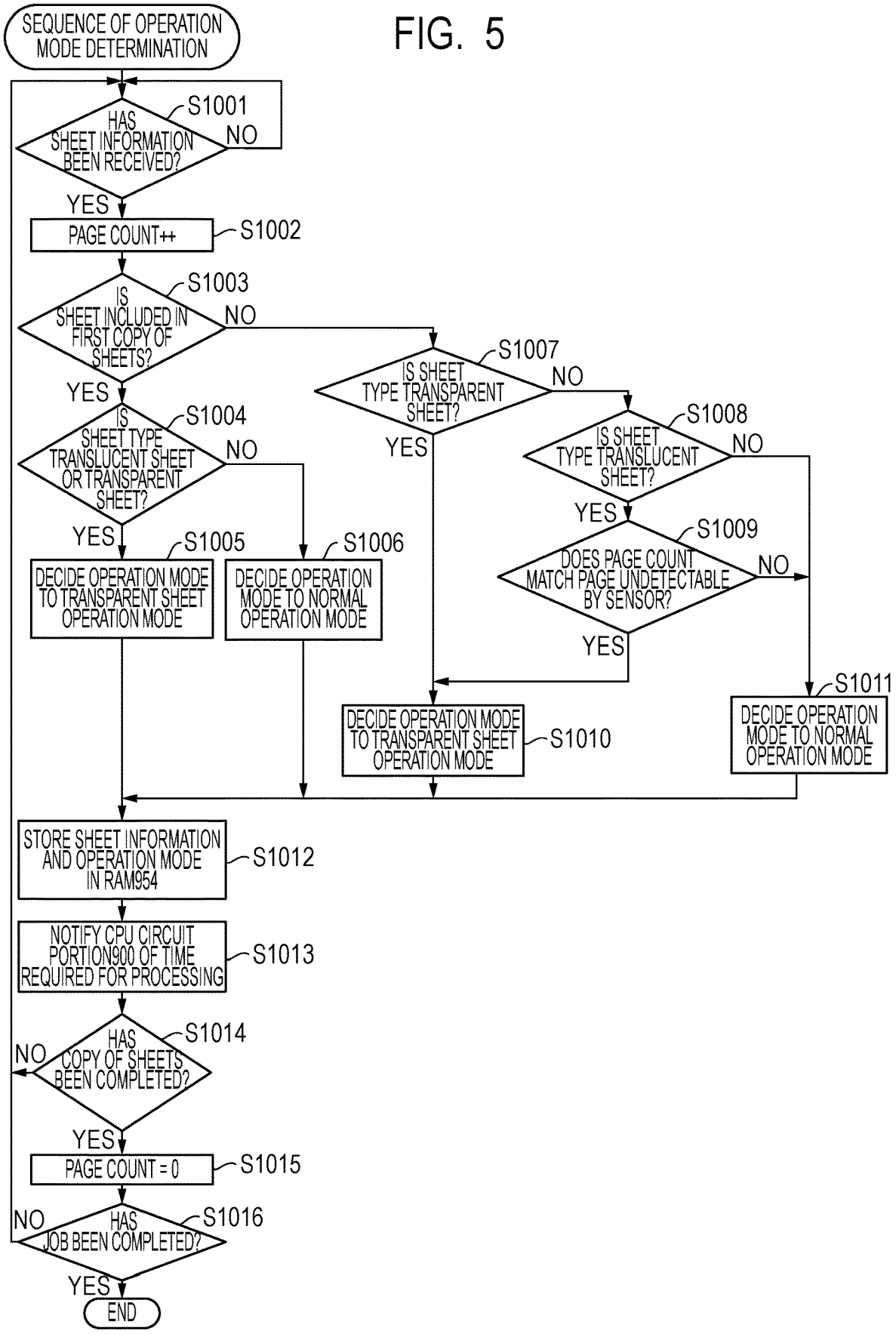
FIG. 5 is a diagram for illustrating a sequence of operation mode determination.

Operation mode determination to be performed by the CPU 952 of the finisher control portion 951 is described with reference to a flow chart illustrated in FIG. 5 and a sheet information format illustrated in FIG. 7A.

In Step S1001, the CPU 952 determines whether or not the sheet information illustrated in FIG. 7A has been received via the communication IC described above. When determining that the sheet information has been received, the CPU 952 stores the sheet information in the RAM 954, and advances the sequence to Step S1002.

In Step S1002, the CPU 952 increments a page count stored in the RAM 954. The page count has an initial value of "0". After the processing of Step S1002 has been completed, the CPU 952 advances the sequence to Step S1003.

In Step S1003, the CPU 952 determines whether or not the sheet is included in a first copy of sheets of the job based on job leading sheet information in the sheet information received in Step S1001. When determining that the sheet is included in the first copy of sheets of the job, the CPU 952 advances the sequence to Step S1004, and when determining that the sheet is not included in the first copy of sheets of the job, the CPU 952 advances the sequence to Step S1007.

When the CPU 952 determines in Step S1003 that the sheet is included in the first copy of sheets of the job, in Step S1004, the CPU 952 determines which of a translucent sheet and a transparent sheet the sheet type is based on the sheet information. When determining that the sheet is a translucent sheet or a transparent sheet, the CPU 952 advances the sequence to Step S1005, and when determining that the sheet is not a translucent sheet or a transparent sheet, the CPU 952 advances the sequence to Step S1006.

As described later, the translucent sheet can also be processed in a normal operation mode being a first post-processing mode depending on a brand name. However, when the translucent sheet is processed in the normal operation mode for the first processing, a malfunction is highly liable to occur. Therefore, it is assumed that the translucent sheet is processed in a transparent sheet operation mode being a second post-processing mode when the translucent sheet is included in the first copy of sheets of the job.

In Step S1005, the CPU 952 decides the operation mode to the transparent sheet operation mode being the second post-processing mode. In Step S1006, the CPU 952 decides the operation mode to the normal operation mode being the first post-processing mode.

After the processing of Step S1005 and Step S1006 has been completed, this sequence proceeds to Step S1012. The post-processing apparatus 500 has the normal operation mode, which is an example of the first post-processing mode, and the transparent sheet operation mode, which is an example of the second post-processing mode different from the normal operation mode in conveyance control. Actual operations in the transparent sheet operation mode and the normal operation mode performed when the sheet is conveyed are described later.

When determining in Step S1003 that the sheet is not included in the first copy of sheets of the job, in Step S1007, the CPU 952 determines based on the sheet information whether or not the sheet type is a transparent sheet. When determining that the sheet type is a transparent sheet, the CPU 952 advances the sequence to Step S1010, and when determining that the sheet type is not a transparent sheet, the CPU 952 advances the sequence to Step S1008.

When the CPU 952 determines in Step S1007 that the sheet type is not a transparent sheet, in Step S1008, the CPU 952 determines based on the sheet information whether or not the sheet type is a translucent sheet. When determining that the sheet type is a translucent sheet, the CPU 952 advances the sequence to Step S1009, and when determining that the sheet type is not a translucent sheet, the CPU 952 advances the sequence to Step S1011.

When determining in Step S1008 that the sheet type is a translucent sheet, in Step S1009, the CPU 952 determines whether or not sensor-undetectable translucent sheet page information stored in the RAM 954, which is described later, includes a page having a page count matching the current page count stored in the RAM 954. For example, when a sensor-undetectable translucent sheet page is in a state illustrated in FIG. 14 and the current page count has a value of "3", the CPU 952 determines that the sensor-undetectable translucent sheet page information includes a page having a page count whose value matches that of the current page count.

When determining that the sensor-undetectable translucent sheet page information includes a page having a matching page count, the CPU 952 advances the sequence to Step S1010, and when determining that the sensor-undetectable translucent sheet page information does not include a page having a matching page count, the CPU 952 advances the sequence to Step S1011.

When determining in Step S1007 that the sheet is a transparent sheet or when determining in Step S1009 that the sensor-undetectable translucent sheet page information includes a page having a matching page count, in Step S1010, the CPU 952 decides the operation mode to the transparent sheet operation mode.

When determining in Step S1008 that the sheet is not a translucent sheet or when determining in Step S1009 that the sensor-undetectable translucent sheet page information does not include a page having a matching page count, the CPU 952 decides the operation mode to the normal operation mode. After the processing of Step S1010 and Step S1011 has been completed, the sequence proceeds to Step S1012.

In Step S1012, the CPU 952 stores the sheet information received in Step S1001 and the decided operation mode in the RAM 954, and advances the sequence to Step S1013.

Figure 17:
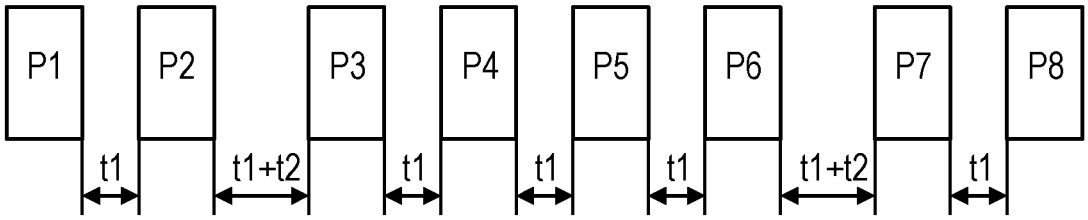
FIG. 17 is a diagram for illustrating a sheet interval time at a time of sheet conveyance.

In Step S1013, the CPU 952 calculates a time required for processing based on the sheet information and the decided operation mode, and notifies the CPU circuit portion 900 of the calculated time via the communication IC. In a normal case, the time required for processing is longer in the transparent sheet operation mode than in the normal operation mode when the sheet information other than the sheet type is the same. For example, as illustrated in FIG. 17, when sheets P1, P2, P4, P5, P6, and P8 are processed in the normal operation mode and sheets P3 and P7 are processed in the transparent sheet operation mode, the sheet interval time is set longer for the sheets P3 and P7. After that, the sequence proceeds to Step S1014.

In Step S1014, the CPU 952 determines whether or not the copy of sheets has been completed based on bundle leading sheet/bundle last sheet information in the sheet information. When determining that the copy of sheets has been completed, the CPU 952 advances the sequence to Step S1015, and when determining that the copy of sheets has not been completed, the CPU 952 advances the sequence to Step S1001. The processing of from Step S1001 to Step S1013 is repeatedly performed until the copy of sheets has been completed.

In Step S1015, the CPU 952 clears the page count stored in the RAM 954 to "0". After the processing has been completed, the CPU 952 advances the sequence to Step S1016.

In Step S1016, the CPU 952 determines whether or not the job has been completed based on job leading sheet/last sheet information in the sheet information. When determining that the job has not been completed, the CPU 952 advances the sequence to Step S1001, and repeatedly performs the processing of from Step S1001 to Step S1015 until the job has been completed. When determining that the job has been completed, the CPU 952 brings processing for the operation mode determination to an end.

With the above-mentioned processing, the CPU 952 decides an optimum operation mode for each sheet. The description of the first embodiment is directed to a method of notifying the CPU circuit portion 900 of the time required for processing based on the operation mode time in units of single sheets in Step S1013. However, the control may be performed so as to notify the CPU circuit portion 900 of the time required for processing based on the operation mode in units of single bundles on which the stapling or other such post-processing is to be performed.

Figure 6:
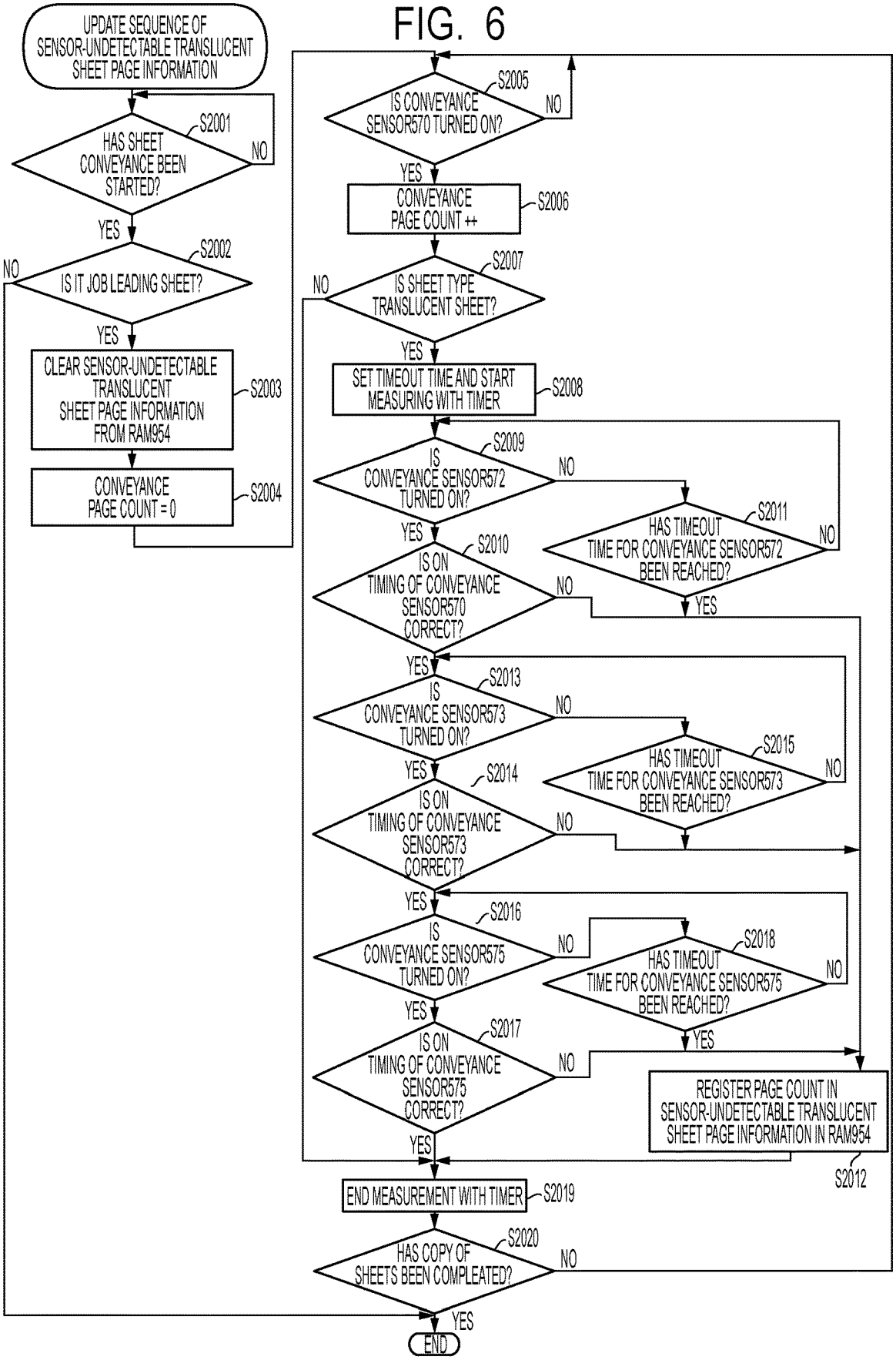
FIG. 6 is a diagram for illustrating a sequence of translucent sheet determination.

Next, translucent sheet determination to be performed by the CPU 952 of the finisher control portion 951 is described with reference to a flow chart illustrated in FIG. 6.

The translucent sheet determination is processing for updating the sensor-undetectable translucent sheet page information to be used for the determination in Step S1009 of the above-mentioned operation mode determination. Further, this processing is performed on the sheet included in the first copy of sheets of the job during the sheet conveyance, and is not performed on the sheet included in the second copy and the subsequent copies.

In Step S2001, the CPU 952 determines whether or not to start the conveyance of the sheet based on whether or not "sheet discharge information" to be notified of by the CPU circuit portion 900 via the communication IC when the image forming apparatus 10 discharges the sheet toward the post-processing apparatus 500 has been received. When determining that the "sheet discharge information" was received and the conveyance of the sheet is to be started, the CPU 952 advances the sequence to Step S2002.

In the subsequent steps, the CPU 952 performs control through use of a piece of sheet information having a sheet ID matching a sheet ID notified of with the "sheet discharge information" among pieces of sheet information for each sheet stored in the RAM 954. The sheet information used in the first embodiment is illustrated in FIG. 7A.

In Step S2002, the CPU 952 determines whether or not the conveyed sheet is a leading sheet of the job based on the job leading sheet/last sheet information in the sheet information. When determining that the conveyed sheet is not the leading sheet of the job, the CPU 952 brings the operation for the translucent sheet determination to an end. When determining that the conveyed sheet is the leading sheet of the job, the CPU 952 advances the sequence to Step S2003.

In Step S2003, the CPU 952 clears the sensor-undetectable translucent sheet page information stored in the RAM 954. The sensor-undetectable translucent sheet page information represents information on a page of a translucent sheet that cannot be detected by the light transmissive conveyance sensors 572, 573, and 575, and is recorded by the CPU 952. After having cleared the sensor-undetectable translucent sheet page information, the CPU 952 advances the sequence to Step S2004.

In Step S2004, the CPU 952 clears a conveyance page count stored in the RAM 954 to "0". The conveyance page count represents a value stored in the RAM 954 by the CPU 952 by counting the number of sheets in the first copy of sheets of the job that have been conveyed to the post-processing apparatus 500. After having cleared the conveyance page count to "0", the CPU 952 advances the sequence to Step S2005.

In Step S2005, the CPU 952 determines whether or not the light reflective conveyance sensor 570 is in an on state. When determining that the sheet has been conveyed and the light reflective conveyance sensor 570 has been turned on, the CPU 952 advances the sequence to Step S2006.

In Step S2006, the CPU 952 increments the conveyance page count. After the processing has been completed, the sequence proceeds to Step S2007.

In Step S2007, the CPU 952 determines whether or not the sheet type is a translucent sheet based on the sheet type in the sheet information stored in the RAM 954. When determining that the sheet type is not a translucent sheet, the CPU 952 advances the sequence to Step S2019, and when determining that the sheet type is the translucent sheet, the CPU 952 advances the sequence to Step S2008.

In Step S2008, the CPU 952 calculates times required before a leading edge of the sheet reaches the respective light transmissive conveyance sensors 572, 573, and 575 based on sheet conveyance distances from the light reflective conveyance sensor 570 to the respective light transmissive conveyance sensors 572, 573, and 575 and a sheet conveying speed including acceleration or deceleration of the sheet. The CPU 952 starts measuring with a timer by setting values obtained by adding a fixed margin to the calculated values as timeout times for the respective sensors 572, 573, and 575. In the first embodiment, the margin is set to 30 ms. After having completed the processing, the CPU 952 advances the sequence to Step S2009.

In Step S2009, the CPU 952 determines whether or not the light transmissive conveyance sensor 572 is in an on state. When determining that the light transmissive conveyance sensor 572 is not in an on state, the CPU 952 advances the sequence to Step S2011 to determine whether or not the timer has reached the timeout time for the light transmissive conveyance sensor 572. When the timeout time has not been reached, the CPU 952 advances the sequence to Step S2009 to repeat the determination as to whether or not the light transmissive conveyance sensor 572 is in an on state. When determining that the timeout time has been reached, the CPU 952 advances the sequence to Step S2012. When determining in Step S2009 that the light transmissive conveyance sensor 572 is in an on state, the CPU 952 advances the sequence to Step S2010.

In Step S2010, the CPU 952 determines whether or not the on timing of the light transmissive conveyance sensor 572 is correct based on whether or not the current timer is earlier than a value obtained by subtracting a fixed margin from the timeout time. When determining that the on timing of the sensor is earlier and the timing is not correct, the CPU 952 advances the sequence to Step S2012, and when determining that the on timing of the sensor is correct, the CPU 952 advances the sequence to Step S2013. In the first embodiment, the margin is set to 60 ms.

In Step S2013 to Step S2015 and Step S2016 to Step S2018, the CPU 952 executes the same processing as that of from Step S2009 to Step S2011 on the light transmissive conveyance sensors 573 and 575, respectively.

When determining in Step S2011, Step S2015, and Step S2018 that the timeout times for the conveyance sensors 572, 573, and 575 have been reached, respectively, the CPU 952 advances the sequence to Step S2012. When determining in Step S2010, Step S2014, and Step S2017 that the on timings of the conveyance sensors 572, 573, and 575 are not correct, respectively, the CPU 952 also advances the sequence to Step S2012. Then, the CPU 952 registers the value of the conveyance page count in the sensor-undetectable translucent sheet page information stored in the RAM 954. For example, when the sheet having a page count whose value is "7", namely, a translucent sheet of the seventh page, cannot be detected by the light transmissive conveyance sensors 572, 573, and 575, the CPU 952 stores "7" being the value of the page count in the RAM 954 as illustrated in FIG. 14.

When determining in Step S2017 that the on timing of the light transmissive conveyance sensor 575 is correct, the CPU 952 advances the sequence to Step S2019 to bring the measuring with the timer started in Step S2008 to an end. After the processing has been completed, the sequence proceeds to Step S2020.

In Step S2020, the CPU 952 determines whether or not the copy of sheets has been completed based on the bundle leading sheet/bundle last sheet information in the sheet information. When determining that the copy of sheets has not been completed, the CPU 952 advances the sequence to Step S2005 to repeat the processing of from Step S2005 to Step S2019 on the subsequently-conveyed sheet. When determining that the copy of sheets has been completed, the CPU 952 brings processing for the translucent sheet determination to an end.

With the above-mentioned operation, the CPU 952 determines whether or not the light transmissive conveyance sensors 572, 573, and 575 can detect the sheet within ±30 ms of the set timings. With this determination, the translucent sheet that cannot be detected by the light transmissive conveyance sensors 572, 573, and 575 can be identified from among the sheets forming the copy. The sensor-undetectable translucent sheet page information stored in the RAM 954 by this operation is used in Step S1009 of the above-mentioned operation mode determination.

Figure 8:
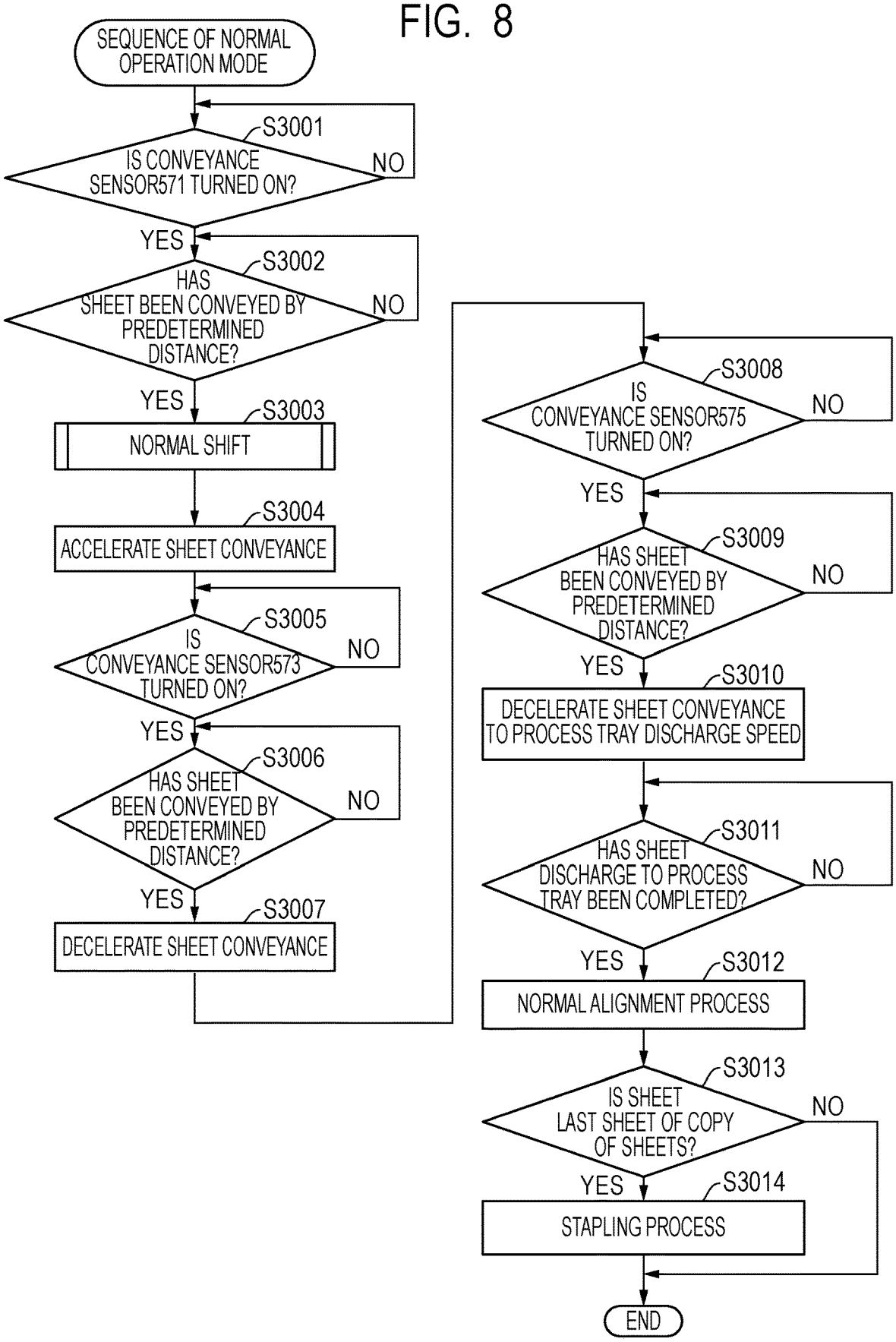
FIG. 8 is a diagram for illustrating a sequence of a normal operation mode.

Next, the operation of the post-processing apparatus 500 to be performed on the sheet for which the normal operation mode has been determined by the CPU 952 through the above-mentioned operation mode determination is described with reference to a flow chart illustrated in FIG. 8. This description is directed to an exemplary case in which the "staple" is designated in the post-processing.

When the light reflective conveyance sensor 570 is turned on by the conveyed sheet, the CPU 952 starts this operation. The light reflective conveyance sensor 570 is not used for the control in this operation, and is omitted from the flow chart illustrated in FIG. 8.

In Step S3001, the CPU 952 determines whether or not the light reflective conveyance sensor 571 is in an on state. When determining that the light reflective conveyance sensor 571 is in an on state, the CPU 952 advances the sequence to Step S3002.

In Step S3002, the CPU 952 determines whether or not the sheet has been conveyed by a predetermined distance based on a speed of the conveyance roller pair 512 driven by the inlet motor Ml, and when determining that the sheet has been conveyed by the predetermined distance, the CPU 952 advances the sequence to Step S3003.

In Step S3003, the CPU 952 performs processing for a normal shift on the sheet. The processing for the normal shift is described later.

After having completed the processing, the CPU 952 advances the sequence to Step S3004. In Step S3004, the CPU 952 accelerates the inlet motor M1 and the buffer motor M2 to accelerate the conveyance of the sheet by the conveyance roller pairs 512, 513, 514, and 516.

Then, in Step S3005, the CPU 952 determines whether or not the light transmissive conveyance sensor 573 is in an on state. When determining that the light transmissive conveyance sensor 573 is in an on state, the CPU 952 advances the sequence to Step S3006.

In Step S3006, the CPU 952 determines whether or not the sheet has been conveyed by a predetermined distance based on the speed of the conveyance roller pair 514 driven by the buffer motor M2. When determining that the sheet has been conveyed by the predetermined distance, the CPU 952 advances the sequence to Step S3007.

In Step S3007, the CPU 952 decelerates the buffer motor M2, the discharge motor M3, and the bundle discharge motor M5 to decelerate the conveyance of the sheet by the conveyance roller pairs 514, 516, 517, 518, and 680.

After the processing has been completed, the sequence proceeds to Step S3008. In Step S3008, the CPU 952 determines whether or not the light transmissive conveyance sensor 575 is in an on state. When determining that the light transmissive conveyance sensor 575 is in an on state, the CPU 952 advances the sequence to Step S3009.

In Step S3009, the CPU 952 determines whether or not the sheet has been conveyed by a predetermined distance based on the speed of the conveyance roller pair 517 driven by the discharge motor M3. When determining that the sheet has been conveyed by the predetermined distance, the CPU 952 advances the sequence to Step S3010.

In Step S3010, the CPU 952 decelerates the discharge motor M3 to a process tray discharge speed to decelerate the conveyance of the sheet by the conveyance roller pairs 517 and 518. In addition, the CPU 952 drives the paddle 660 by the paddle motor M6 to discharge the sheet to the process tray 630. When those processing steps are completed, the sequence proceeds to Step S3011.

In Step S3011, the CPU 952 determines whether or not sheet discharge to the process tray 630 has been completed based on whether or not the conveyance of the sheet has been performed for a predetermined time period since the light reflective conveyance sensor 576 was turned off. When determining that the sheet discharge to the process tray 630 has been completed, the CPU 952 advances the sequence to Step S3012.

Figure 16A:
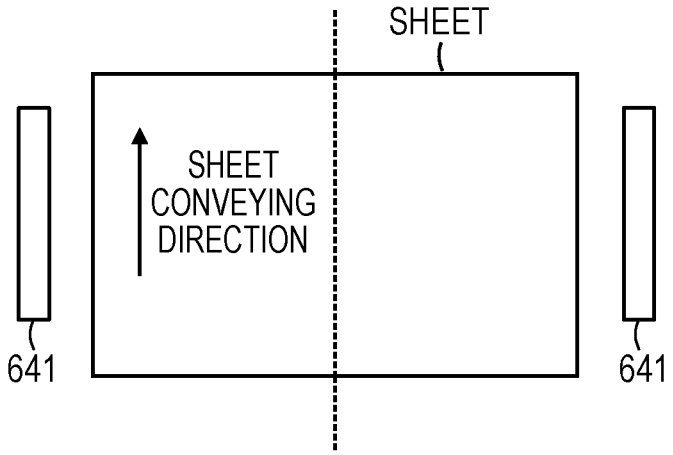
FIG. 16A and FIG. 16B are diagrams for each illustrating alignment waiting positions of alignment members.

In Step S3012, the CPU 952 aligns the sheet discharged to the process tray 630 by causing the alignment motor M7 to operate the alignment members 641. At this time, the CPU 952 performs the alignment by moving the alignment members 641 from alignment waiting positions to alignment positions in the sheet width direction. In this case, as illustrated in FIG. 16A, in the normal operation mode, an interval between the pair of alignment members 641 at the alignment waiting positions is set to an interval between such positions as to have a width wider than a sheet width in the sheet information. In the first embodiment, the interval is set to an interval between such positions as to have a width wider than the sheet width by 10 mm. In this manner, the alignment waiting positions of the alignment members 641 are set so as not to have such a wide width, to thereby be able to improve productivity.

After the alignment process has been completed, the sequence proceeds to Step S3013. In Step S3013, the CPU 952 determines whether or not the sheet discharged to the process tray 630 is the last sheet of the copy based on the job leading sheet/last sheet information in the sheet information.

When determining that the sheet is not the last sheet of the copy, the CPU 952 brings the normal operation mode to an end, and when determining that the sheet is the last sheet of the copy, the CPU 952 advances the sequence to Step S3014.

This description is directed to the exemplary case in which the "staple" is designated, and hence in Step S3014, the CPU 952 performs the stapling process on a bundle of sheets stacked on the process tray 630. The CPU 952 operates the stapler moving motor M9 to move the stapler 631 to a position for stapling the sheet bundle. After that, the CPU 952 operates the staple motor M8 to drive the stapler 631, to thereby subject the sheet bundle to the stapling process. After the stapling process has been completed, the normal operation mode is brought to an end.

With the above-mentioned operation, the processing for the normal shift is performed through use of a light transmissive conveyance sensor having a high ability to detect a sheet edge. With this processing, it is possible to increase positional precision in the sheet width direction, and to accurately control the acceleration or deceleration and alignment timing of the sheet, which allows the post-processing to be performed with high accuracy.

Figure 9:
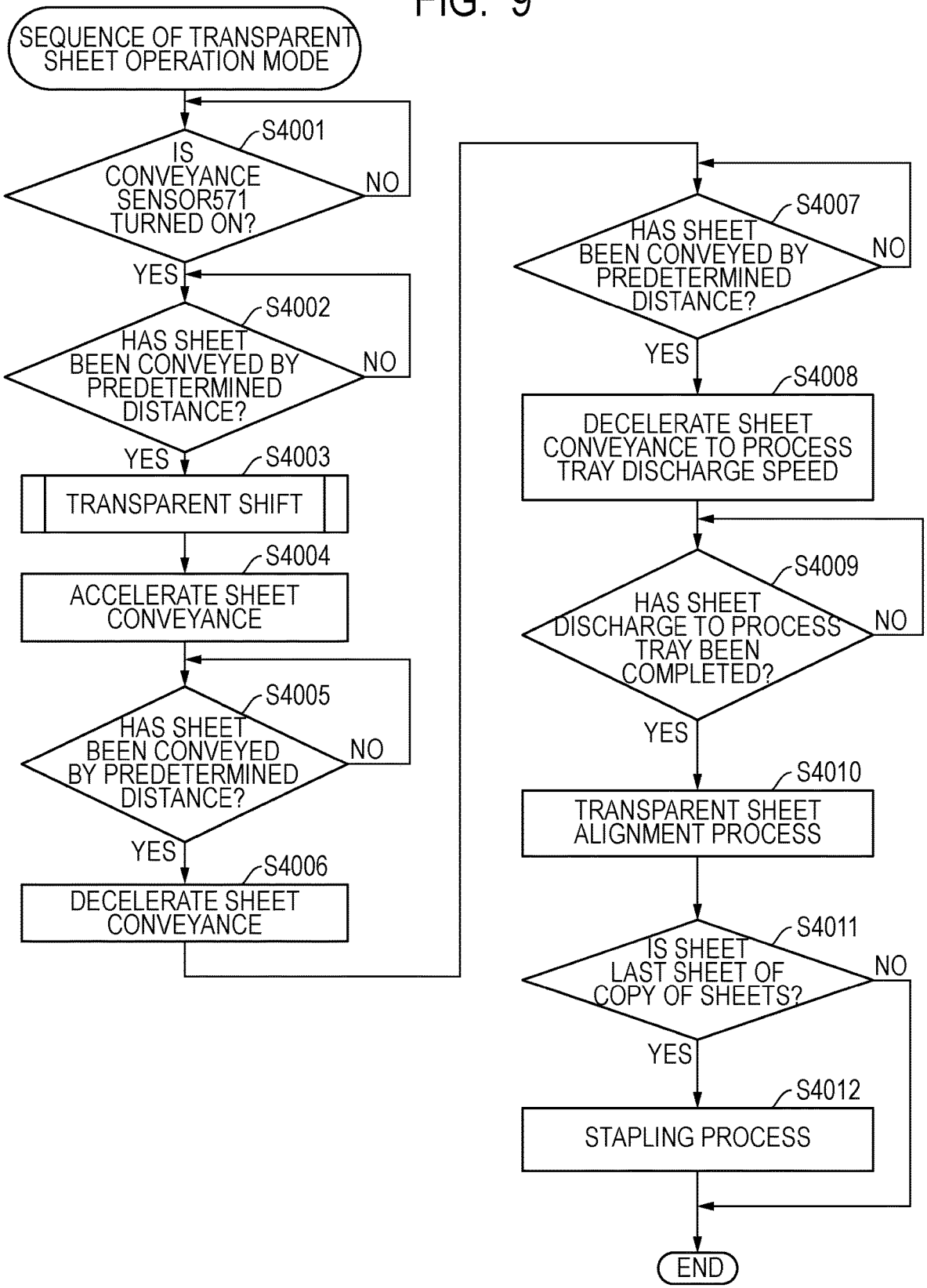
FIG. 9 is a diagram for illustrating a sequence of a transparent sheet operation mode.

Next, the operation of the post-processing apparatus 500 to be performed on the sheet for which the transparent sheet operation mode has been determined by the CPU 952 through the above-mentioned operation mode determination is described with reference to a flow chart illustrated in FIG. 9. This description is directed to an exemplary case in which the "staple" is designated in the post-processing.

When the light reflective conveyance sensor 570 is turned on by the conveyed sheet, the CPU 952 starts this operation. The light reflective conveyance sensor 570 is not used for the control in this operation, and is omitted from the flow chart illustrated in FIG. 9.

In Step S4001, the CPU 952 determines whether or not the light reflective conveyance sensor 571 is in an on state. When determining that the light reflective conveyance sensor 571 is in an on state, the CPU 952 advances the sequence to Step S4002.

In Step S4002, the CPU 952 determines whether or not the sheet has been conveyed by a predetermined distance based on a speed of the conveyance roller pair 512 driven by the inlet motor M1, and when determining that the sheet has been conveyed by the predetermined distance, the CPU 952 advances the sequence to Step S4003.

The sheet interval time is set longer in the case of the transparent sheet operation mode than in the case of the normal operation mode. That is, the time interval between the passage of a preceding sheet and the conveyance of the transparent sheet is set longer than the time interval between the passage of the preceding sheet and the conveyance of the normal sheet. For example, when the sheets P1, P2, P4, P5, P6, and P8 are processed in the normal operation mode and the sheets P3 and P7 are processed in the transparent sheet operation mode, the sheet interval times for the sheets P3 and P7 are set longer as illustrated in FIG. 17. In Step S4003, the CPU 952 subjects the sheet to processing for a transparent shift. The processing for the transparent shift is described later.

After having completed the processing for the transparent shift, the CPU 952 advances the sequence to Step S4004. In Step S4004, the CPU 952 accelerates the inlet motor M1 and the buffer motor M2 to accelerate the conveyance of the sheet by the conveyance roller pairs 512, 513, 514, and 516.

In Step S4005, the CPU 952 determines whether or not the sheet has been conveyed by a predetermined distance based on the speed of the conveyance roller pair 514 driven by the buffer motor M2, and when determining that the sheet has been conveyed by the predetermined distance, the CPU 952 advances the sequence to Step S4006. In Step S4006, the CPU 952 decelerates the buffer motor M2, the discharge motor M3, and the bundle discharge motor M5 to decelerate the conveyance of the sheet by the conveyance roller pairs 514, 516, 517, 518, and 680.

In Step S4007, the CPU 952 determines whether or not the sheet has been conveyed by a predetermined distance based on the speed of the conveyance roller pair 517 driven by the discharge motor M3. When determining that the sheet has been conveyed by the predetermined distance, the CPU 952 advances the sequence to Step S4008.

In Step S4008, the CPU 952 decelerates the discharge motor M3 to a process tray discharge speed to decelerate the conveyance of the sheet by the conveyance roller pairs 517 and 518. In addition, the CPU 952 drives the paddle 660 by the paddle motor M6 to discharge the sheet to the process tray 630. When those processing steps are completed, the sequence proceeds to Step S4009.

In Step S4009, the CPU 952 determines whether or not sheet discharge to the process tray 630 has been completed based on whether or not the conveyance of the sheet has been performed for a predetermined time period since the light reflective conveyance sensor 576 was turned off. When determining that the sheet discharge to the process tray 630 has been completed, the CPU 952 advances the sequence to Step S4010.

Figure 16B:
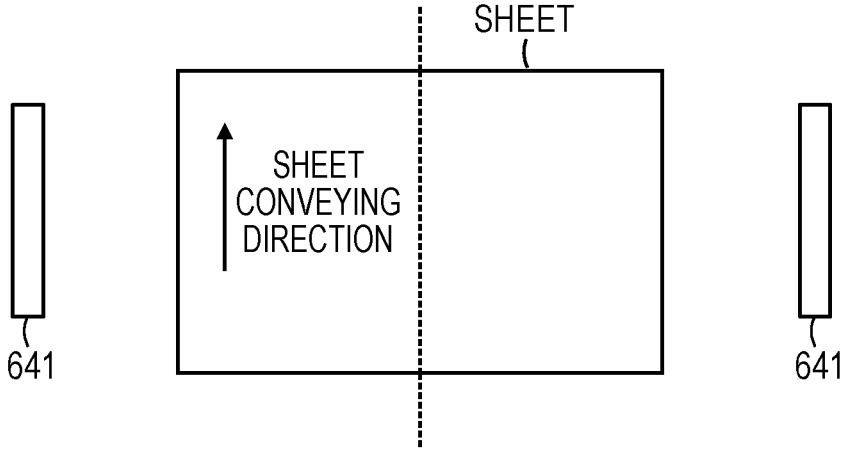

In Step S4010, the CPU 952 aligns the sheet discharged to the process tray 630 by causing the alignment motor M7 to operate the alignment members 641. At this time, the CPU 952 performs the alignment by moving the alignment members 641 from alignment waiting positions to alignment positions in the sheet width direction. As exemplified in FIG. 16B, in the transparent sheet operation mode, the interval between the pair of alignment members 641 at the alignment waiting positions is an interval between such positions as to have a width wider than the sheet width of the sheet, and is set to an interval wider than the interval between the alignment waiting positions in the normal operation mode. In the first embodiment, the interval is set to an interval between such positions as to have a width wider than the sheet width by 30 mm. This is because, due to the fact that the transparent sheet is a sheet that cannot be detected by the light transmissive conveyance sensor, position adjustment in the sheet width direction cannot be performed sufficiently, and variations in sheet position in the width direction may be larger than in the case of the normal sheet.

After the alignment process has been completed, the sequence proceeds to Step S4011. In Step S4011, the CPU 952 determines whether or not the sheet discharged to the process tray 630 is the last sheet of the copy. When determining that the sheet is not the last sheet of the copy, the CPU 952 brings the transparent sheet operation mode to an end, and when determining that the sheet is the last sheet of the copy, the CPU 952 advances the sequence to Step S4012.

This description is directed to the exemplary case in which the "staple" is designated as the post-processing, and hence in Step S4012, the CPU 952 performs the stapling process on a bundle of sheets stacked on the process tray 630. The CPU 952 operates the stapler moving motor M9 to move the stapler 631 to the position for stapling the sheet bundle. After that, the CPU 952 operates the staple motor M8 to drive the stapler 631, to thereby subject the sheet bundle to the stapling process. After the stapling process has been completed, the transparent sheet operation mode is brought to an end.

With the above-mentioned operation, processing for the shift is performed on the transparent sheet as well through use of a light reflective conveyance sensor. With this processing, although accuracy of the post-processing is inferior to accuracy exhibited in the above-mentioned normal operation mode, it is possible to perform appropriate post-processing by accelerating or decelerating the sheet and calculating an alignment timing so as to control even the transparent sheet or other such sheet that cannot be detected by the light transmissive conveyance sensor.

Figure 12:
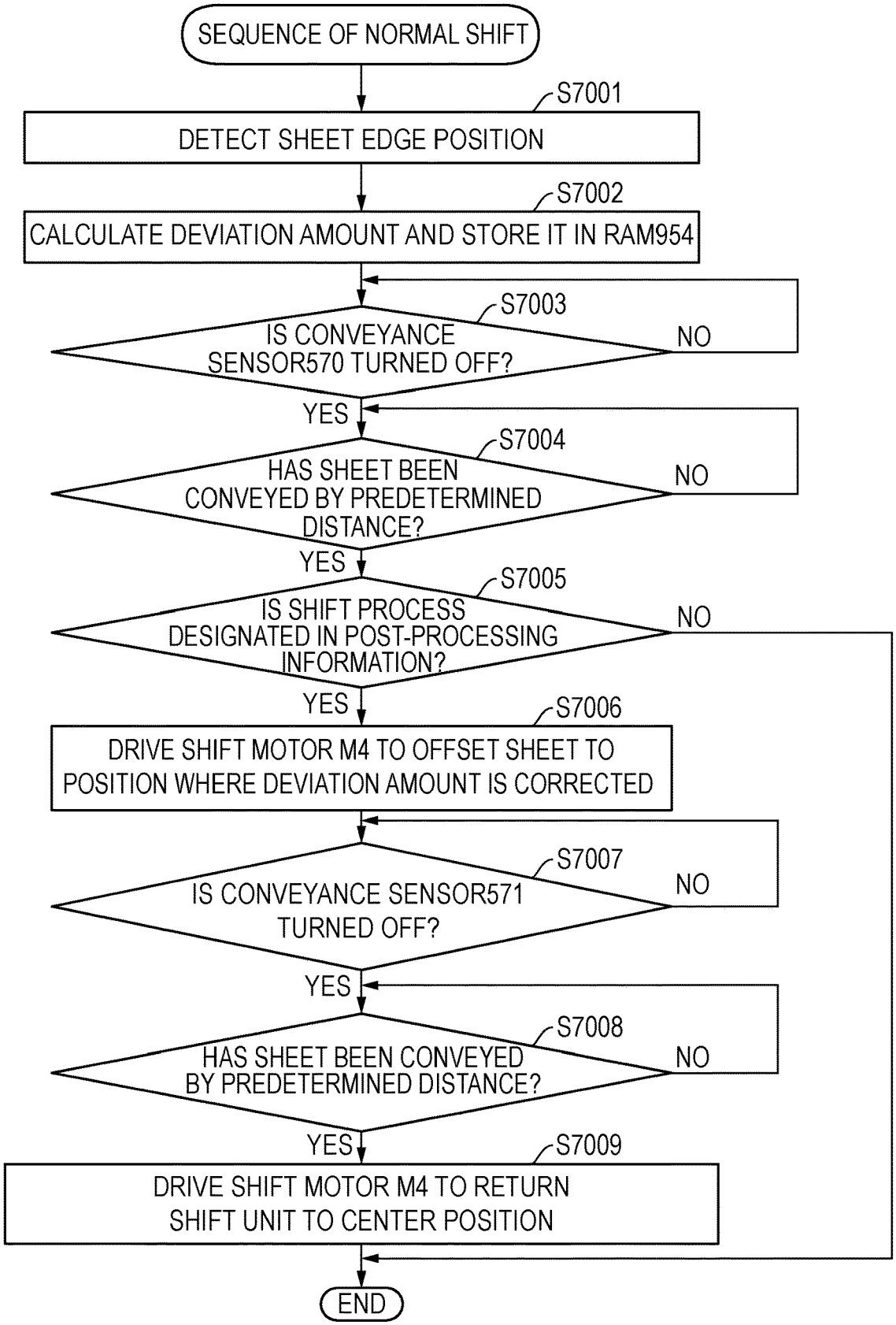
FIG. 12 is a diagram for illustrating a sequence of a normal shift.

Next, an operation for the normal shift to be performed by the shift unit 580 of the post-processing apparatus 500 is described with reference to a flow chart illustrated in FIG. 12 and the sheet information illustrated in FIG. 7A.

In Step S7001, the CPU 952 detects an edge portion position in the sheet width direction with reference to the center position of the conveyance path 520 through input from the sheet width position sensing sensor 577.

In Step S7002, the CPU 952 calculates the deviation amount of the sheet in the width direction. The deviation amount is calculated as a difference between a half of the sheet width in the sheet information illustrated in FIG. 7A and the edge portion position in the sheet width direction detected in Step S7001. With this calculation, the CPU 952 can acquire the deviation amount between the center position of the conveyance path 520 and the center position of the sheet in the width direction. The CPU 952 stores the calculated deviation amount of the sheet in the width direction in the RAM 954, and after having completed the processing, the CPU 952 advances the sequence to Step S7003.

In Step S7003, the CPU 952 determines whether or not the light reflective conveyance sensor 570 is in an off state. When detecting the off state of the light reflective conveyance sensor 570, the CPU 952 advances the sequence to Step S7004.

In Step S7004, the CPU 952 determines whether or not the sheet has been conveyed by a predetermined distance based on the speed of the conveyance roller pair 512 driven by the inlet motor M1. In this case, the predetermined distance represents a distance required before a trailing edge portion of the sheet in the conveying direction has passed through the conveyance roller pair 511. When determining that the sheet has been conveyed by the predetermined distance, the CPU 952 advances the sequence to Step S7005.

In Step S7005, the CPU 952 determines whether or not the processing for the shift is designated by post-processing information in the sheet information. When determining that the processing for the shift is not designated, the CPU 952 brings this sequence to an end. When determining that the processing for the shift is designated, the CPU 952 advances the sequence to Step S7006.

In Step S7006, the CPU 952 performs offset processing by driving the shift motor M4 to move the shift unit 580 in the sheet width direction with the sheet being nipped by the conveyance roller pair 512. The CPU 952 decides a movement direction and a movement amount of the shift unit 580 based on the deviation amount calculated in Step S7002 and information indicating one of the back shift and the front shift, which is designated by the post-processing information.

Next, in Step S7007, the CPU 952 determines whether or not the light reflective conveyance sensor 570 is in an off state. When detecting the off state of the light reflective conveyance sensor 571, the CPU 952 advances the sequence to Step S7008.

In Step S7008, the CPU 952 determines whether or not the sheet has been conveyed by a predetermined distance based on the speed of the conveyance roller pair 513 driven by the inlet motor M1. In this case, the predetermined distance represents a distance required before a trailing edge portion of the sheet in the conveying direction has passed through the shift unit 580. When determining that the sheet has been conveyed by the predetermined distance, the CPU 952 advances the sequence to Step S7009.

In Step S7009, the CPU 952 drives the shift motor M4 to move the shift unit 580 to the center position of the conveyance path 520. After the processing has been completed, the sequence is brought to an end.

Figure 13:
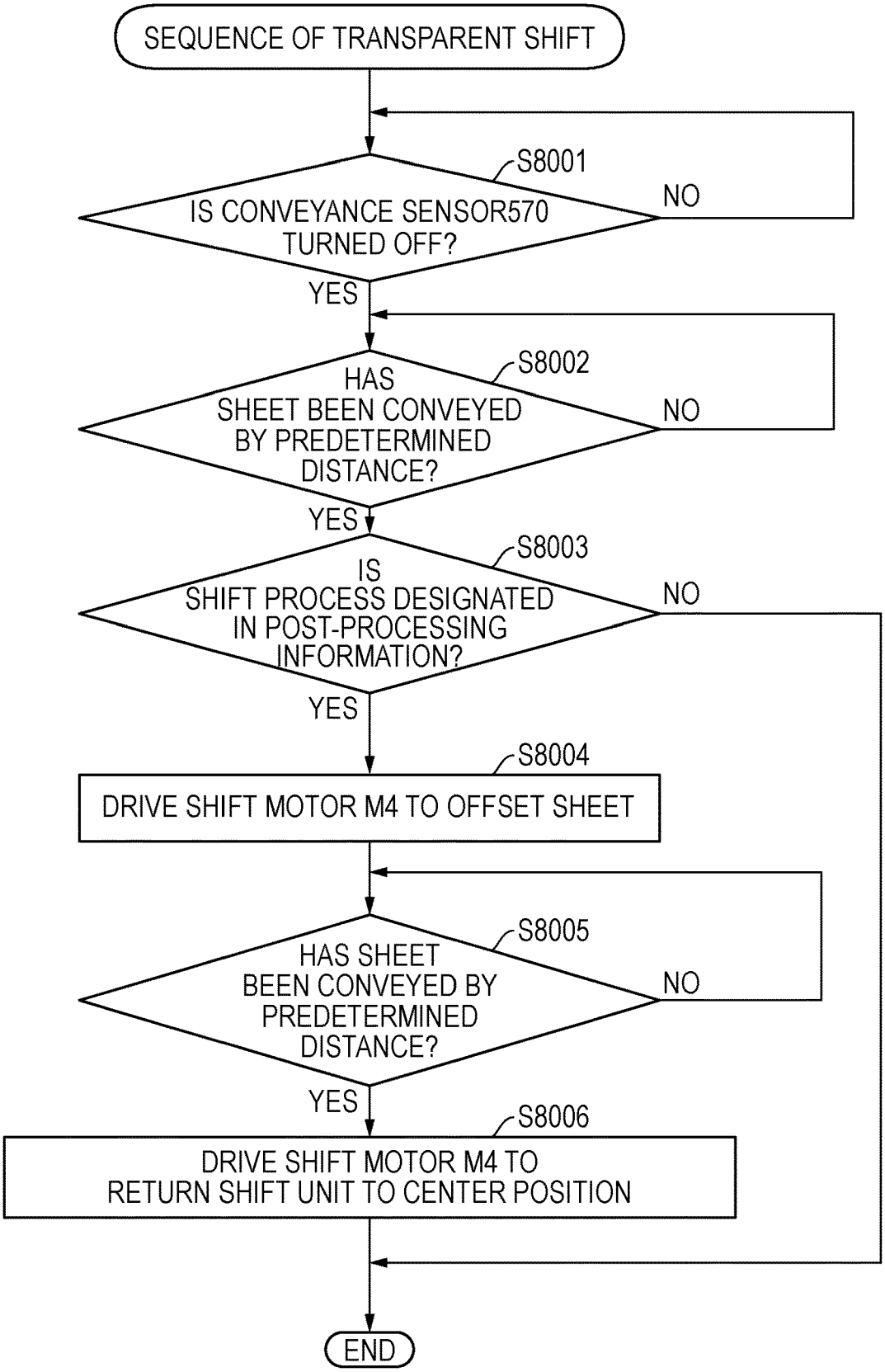
FIG. 13 is a diagram for illustrating a sequence of a transparent shift.

Next, an operation for the transparent shift to be performed by the shift unit 580 of the post-processing apparatus 500 is described with reference to a flow chart illustrated in FIG. 13 and the sheet information illustrated in FIG. 7A.

In Step S8001, the CPU 952 determines whether or not the light reflective conveyance sensor 570 is in an off state. When detecting the off state of the light reflective conveyance sensor 570, the CPU 952 advances the sequence to Step S8002.

In Step S8002, the CPU 952 determines whether or not the sheet has been conveyed by a predetermined distance based on the speed of the conveyance roller pair 512 driven by the inlet motor M1. In this case, the predetermined distance represents a distance required before a trailing edge portion of the sheet in the conveying direction has passed through the conveyance roller pair 511. When determining that the sheet has been conveyed by the predetermined distance, the CPU 952 advances the sequence to Step S8003.

In Step S8003, the CPU 952 determines whether or not the processing for the shift is designated by post-processing information in the sheet information. When determining that the processing for the shift is not designated, the CPU 952 brings this sequence to an end. When determining that the processing for the shift is designated, the CPU 952 advances the sequence to Step S8004.

In Step S8004, the CPU 952 performs offset processing by driving the shift motor M4 to move the shift unit 580 in the sheet width direction with the sheet being nipped by the conveyance roller pair 512. The CPU 952 decides a movement direction the shift unit 580 based on information indicating one of the back shift and the front shift, which is designated by the post-processing information. The sheet width position sensing sensor 577 may fail to correctly detect the edge portion of the sheet, and hence the CPU 952 avoids performing correction using the deviation amount in the transparent shift. Therefore, the positional precision in the sheet width direction is not so high in the transparent shift as in the normal shift described above. After the processing has been completed, the sequence proceeds to Step S8005.

In Step S8005, the CPU 952 determines whether or not the sheet has been conveyed by a predetermined distance based on the speed of the conveyance roller pair 513 driven by the inlet motor M1. In this case, the predetermined distance represents a distance required before the trailing edge portion of the sheet in the conveying direction has passed through the shift unit 580. When determining that the sheet has been conveyed by the predetermined distance, the CPU 952 advances the sequence to Step S8006.

In Step S8006, the CPU 952 drives the shift motor M4 to move the shift unit 580 to the center position of the conveyance path 520. After this processing has been completed, the sequence is brought to an end.

According to the first embodiment, the translucent sheet is processed in the same manner as the normal sheet when it is determined that the translucent sheet can be detected by a light transmissive sensor, to thereby be able to prevent an occurrence of a paper jam as well as reduce a decrease in productivity.

Second Embodiment

An entire configuration, operations of different kinds of loads, a normal operation mode operation, and a transparent sheet operation mode operation of an image forming system in a second embodiment of the present invention are the same as those of the image forming system in the first embodiment. In the second embodiment, the components similar to the components of the first embodiment are denoted by the same reference symbols as in the first embodiment.

Figure 10:
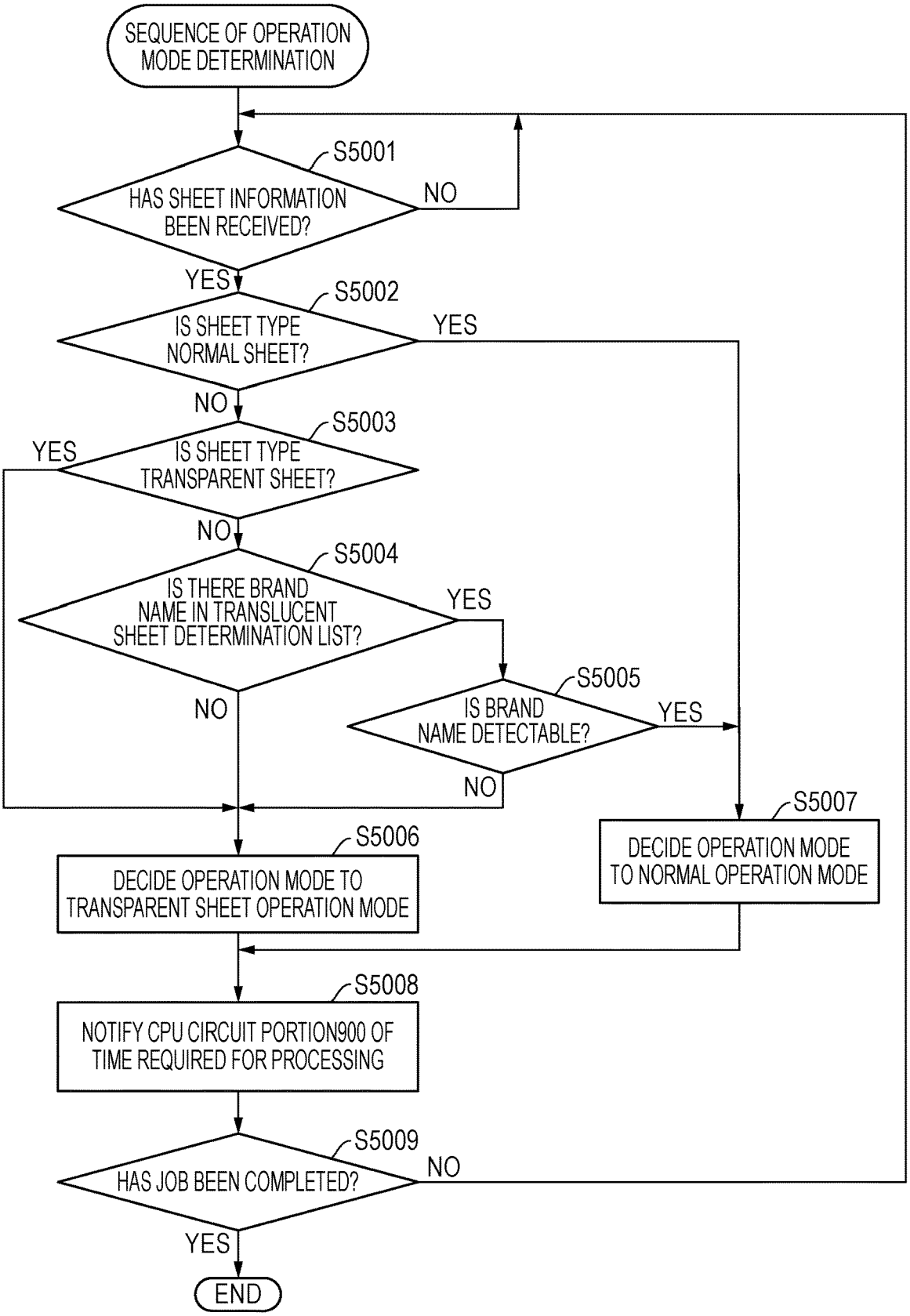
FIG. 10 is a diagram for illustrating a sequence of operation mode determination.

Operation mode determination to be performed by the CPU 952 of the post-processing apparatus 500 according to the second embodiment is described with reference to a flow chart illustrated in FIG. 10, a sheet information format illustrated in FIG. 7B, and a translucent sheet determination list illustrated in FIG. 15.

In Step S5001, the CPU 952 determines whether or not the sheet information illustrated in FIG. 7B has been received via the communication IC described above. When determining that the sheet information has been received, the CPU 952 advances the sequence to Step S5002.

In Step S5002, the CPU 952 determines whether or not the sheet type in the sheet information is a normal sheet. When determining that the sheet type is a normal sheet, the CPU 952 advances the sequence to Step S5007, and when determining that the sheet type is not a normal sheet, the CPU 952 advances the sequence to Step S5003.

In Step S5003, the CPU 952 determines whether or not the sheet type in the sheet information is a transparent sheet. When determining that the sheet type is a transparent sheet, the CPU 952 advances the sequence to Step S5006, and when determining that the sheet type is not a transparent sheet, the CPU 952 determines the sheet type to be a translucent sheet, and advances the sequence to Step S5004.

In Step S5004, the CPU 952 determines whether or not a sheet brand name in the sheet information is included in the translucent sheet determination list described later. When determining that the sheet brand name in the sheet information is not included in the translucent sheet determination list, the CPU 952 advances the sequence to Step S5006, and when determining that the sheet brand name is included in the translucent sheet determination list, the CPU 952 advances the sequence to Step S5005.

In Step S5005, the CPU 952 determines whether or not the sheet brand name in the sheet information is detectable in the translucent sheet determination list. When determining that the sheet brand name is detectable, the CPU 952 advances the sequence to Step S5007, and when determining that the sheet brand name is undetectable, the CPU 952 advances the sequence to Step S5006. For example, in the example of FIG. 15, the sign "○" represents "detectable". The sign "x" represents "undetectable". When the sheet brand name in the sheet information is a brand name A, which is associated with "detectable" in the translucent sheet determination list, the CPU 952 advances the sequence to Step S5007. When the sheet brand name in the sheet information is a brand name C, which is associated with "undetectable" in the translucent sheet determination list, the CPU 952 advances the sequence to Step S5006.

When determining in Step S5003 that the sheet type is a transparent sheet, when determining in Step S5004 that the sheet brand name is not included in the translucent sheet determination list, or when determining in Step S5005 that the sheet brand name is undetectable, the CPU 952 advances the sequence to Step S5006. Then, the CPU 952 decides the operation mode to the transparent sheet operation mode.

Meanwhile, when determining in Step S5002 that the sheet type is the normal sheet and when determining in Step S5005 that the sheet brand name is detectable, the CPU 952 advances the sequence to Step S5007 to decide the operation mode to the normal operation mode.

In Step S5008, the CPU 952 calculates the time required for processing based on the sheet information and the decided operation mode, and notifies the CPU circuit portion 900 of the calculated time via the communication IC. In a normal case, the time required for processing is longer in the transparent sheet operation mode than in the normal operation mode when the sheet information other than the sheet type is the same. When the processing has been completed, the sequence proceeds to Step S5009.

In Step S5009, the CPU 952 determines whether or not the job has been completed based on the job leading sheet/last sheet information in the sheet information. When determining that the job has not been completed, the CPU 952 advances the sequence to Step S5001 to repeat the processing of from Step S5001 to Step S5009 until the job has been completed. When the CPU 952 determines that the job has been completed, this sequence is brought to an end.

Figure 11:
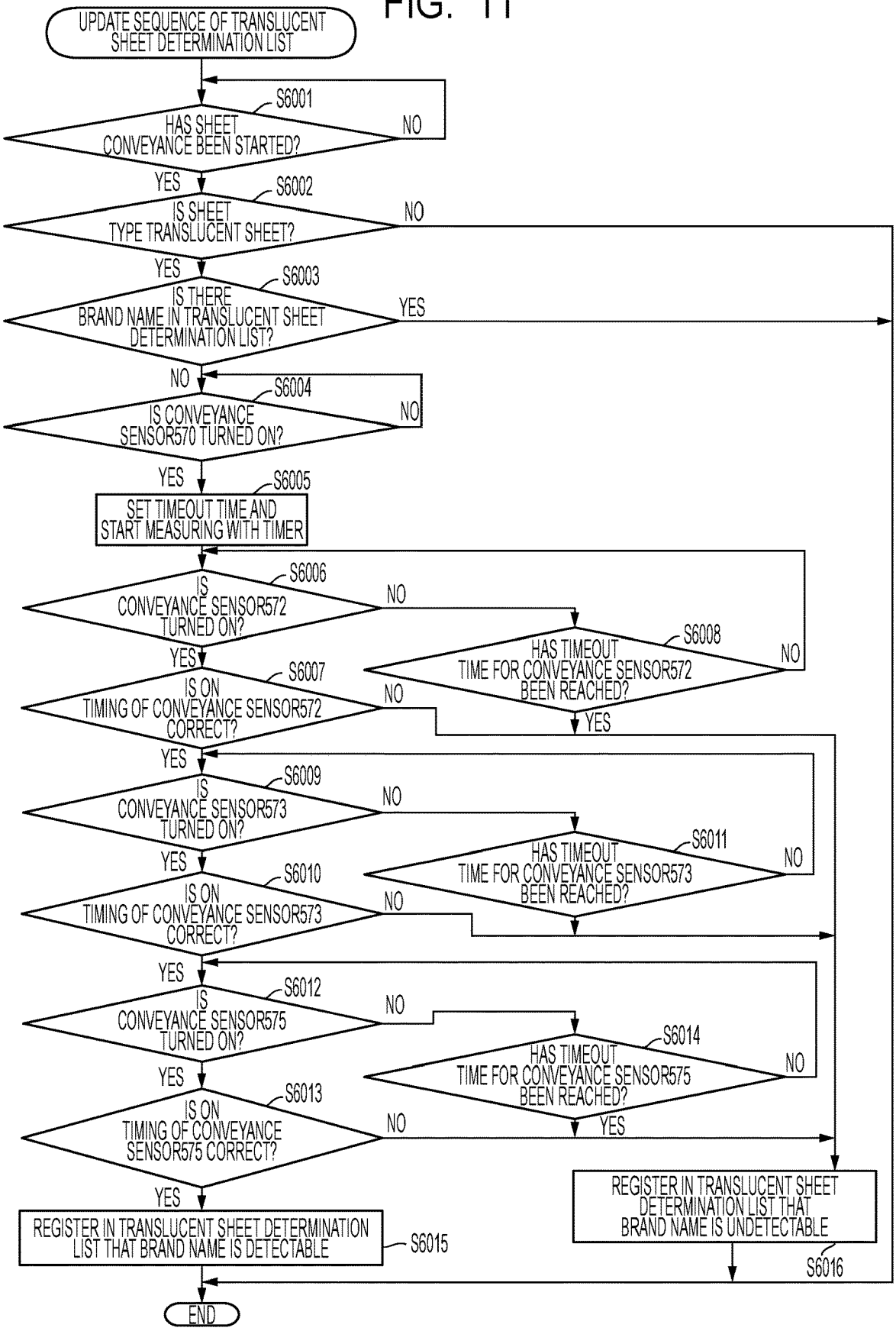
FIG. 11 is a diagram for illustrating an update sequence of a translucent sheet determination list.

Next, update of the translucent sheet determination list to be performed by the CPU 952 of the post-processing apparatus 500 is described with reference to a flow chart illustrated in FIG. 11 and the translucent sheet determination list illustrated in FIG. 15. The update of the translucent sheet determination list is processing for updating the translucent sheet determination list illustrated in FIG. 15 to be used for the above-mentioned determination in Step S5004.

In Step S6001, the CPU 952 determines whether or not the conveyance of the sheet has been started based on whether or not the "sheet discharge information", which is notified of by the CPU circuit portion 900 via the communication IC when the image forming apparatus 10 discharges the sheet to the post-processing apparatus 500, has been received. When receiving the "sheet discharge information" to determine that the conveyance of the sheet has been started, the CPU 952 advances the sequence to Step S6002. In the subsequent steps, the CPU 952 performs control through use of a piece of sheet information having a sheet ID matching a sheet ID notified of with the "sheet discharge information" among pieces of sheet information for each sheet stored in the RAM 954. The sheet information used in the second embodiment is illustrated in FIG. 7B.

In Step S6002, the CPU 952 determines whether or not the sheet is a translucent sheet based on the sheet type in the sheet information. When determining that the sheet is a translucent sheet, an update operation of the translucent sheet determination list is started, and the CPU 952 advances the sequence to Step S6003. When the CPU 952 determines that the sheet is not a translucent sheet, the CPU 952 brings the update operation of the translucent sheet determination list to an end.

In Step S6003, the CPU 952 determines whether or not the sheet brand name in the sheet information is included in the translucent sheet determination list stored in the RAM 954. When the sheet brand name is not included in the translucent sheet determination list, the CPU 952 advances the sequence to Step S6004. When the CPU 952 determines that the sheet brand name is included in the translucent sheet determination list, it is not required to update the translucent sheet determination list, and hence the CPU 952 brings the update operation of the translucent sheet determination list to an end.

In Step S6004, the CPU 952 determines whether or not the conveyance sensor 570 is in an on state. When determining that the conveyance sensor 570 has been turned on after the conveyance of the sheet, the CPU 952 advances the sequence to Step S6005.

The processing to be performed by the CPU 952 in Step S6005 to Step S6014 is the same as the processing of from Step S2008 to Step S2011 and the processing of from Step S2013 to Step S2018 in the operation of the translucent sheet determination in the first embodiment, and hence a description thereof is omitted.

When detecting in Step S6008, Step S6011, and Step S6014 that the timeout times for the light transmissive conveyance sensors 572, 573, and 575 have been reached, respectively, or when determining in Step S6007, Step S6010, and Step S6013 that the on timings of the light transmissive conveyance sensors 572, 573, and 575 are not correct, respectively, the CPU 952 advances the sequence to Step S6016. In Step S6016, the CPU 952 registers in the translucent sheet determination list of the RAM 954 that the sheet brand name in the sheet information is undetectable.

When determining in Step S6013 that the on timing of the conveyance sensor 575 is correct, the CPU 952 advances the sequence to Step S6015. Then, in Step S6015, the CPU 952 registers in the translucent sheet determination list of the RAM 954 that the sheet brand name in the sheet information is detectable.

The description of the second embodiment is directed to the example of storing the translucent sheet determination list in the RAM 954 of the post-processing apparatus 500, but the translucent sheet determination list may be stored in the RAM 903 of the image forming apparatus 10.

Specifically, the CPU 952 determines the operation mode based on the sheet type in the sheet information notified of via the communication IC. When the sheet type is a transparent sheet or a sheet required to be determined as to whether or not the sheet can be processed in the same manner as the transparent sheet, the CPU 952 operates in the transparent sheet operation mode. When the sheet type is other than the above-mentioned sheet types, the CPU 952 operates in the normal operation mode.

Further, when the determination is required for deciding the sheet type, the CPU 952 determines whether or not the sheet is detectable by the light transmissive conveyance sensors 572, 573, and 575, and notifies the CPU circuit portion 900 of the sheet brand name and a determination result thereof via the communication IC.

When the sheet brand name of the translucent sheet to be conveyed to the post-processing apparatus 500 is registered in association with "undetectable" in the translucent sheet determination list stored in the RAM 903, the CPU 901 of the image forming apparatus 10 recognizes the sheet type in the sheet information as a transparent sheet. When the sheet brand name is registered in association with "detectable" in the translucent sheet determination list, the CPU 901 recognizes the sheet type in the sheet information as a translucent sheet, and notifies the post-processing apparatus 500 to that effect via the communication IC.

Further, when the sheet brand name of the translucent sheet to be conveyed to the post-processing apparatus 500 is not included in the translucent sheet determination list stored in the RAM 903, the post-processing apparatus 500 is notified via the communication IC that the translucent sheet has a sheet type for which the sheet information is required to be determined.

After that, when a determination result of the sheet for which the determination is required is notified of from the post-processing apparatus 500, the CPU 901 registers the sheet brand name and the determination result in the translucent sheet determination list of the RAM 903.

As described above, the post-processing apparatus 500 can operate by appropriately discriminating between the normal operation mode and the transparent sheet operation mode.

By performing the operation in the second embodiment, it is possible to prevent a paper jam from occurring during the conveyance of the translucent sheet that may fail to be detected by the light transmissive sensor while using the light transmissive sensor having high sheet position detection accuracy. It is also possible to determine whether or not the translucent sheet that may fail to be detected by the light transmissive sensor, can be detected by the light transmissive sensor, and to perform the processing thereon in an appropriate operation mode based on the determination result, to thereby be able to improve productivity.

According to the second embodiment, the translucent sheet is processed in the same manner as the normal sheet when it is determined that the translucent sheet can be detected by the light transmissive sensor, to thereby be able to prevent the occurrence of a paper jam as well as reduce a decrease in productivity.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-239817, filed Dec. 14, 2017, which is hereby incorporated by reference herein in its entirety.

What is claimed is:

1. A post-processing apparatus to be connected to an image forming apparatus, the post-processing apparatus comprising:

a sheet conveying unit configured to convey a sheet received from the image forming apparatus;

a sheet detecting unit, which is arranged in a conveyance path of the sheet conveying unit, and is configured to detect the sheet; and a post-processing unit configured to perform a post-processing on the sheet conveyed by the sheet conveying unit, wherein the post-processing apparatus is configured to:

perform the post-processing on a sheet of a first type in a first post-processing mode; and perform the post-processing on a sheet of a second type having a light transmittance higher than a light transmittance of the sheet of the first type in a second post-processing mode, which is different from the first post-processing mode in a conveyance control of the sheet conveying unit, and wherein, in a case in which a job for performing the post-processing on a sheet of a third type different in type from the sheet of the first type and the sheet of the second type is executed, the post-processing apparatus is configured to:

determine whether the sheet of the third type is detectable by the sheet detecting unit;

operate in the first post-processing mode when it is determined that the sheet of the third type is detectable by the sheet detecting unit; and operate in the second post-processing mode when it is determined that the sheet of the third type is undetectable by the sheet detecting unit.

2. A post-processing apparatus according to claim 1, wherein the post-processing apparatus operates in the second post-processing mode before the determination is performed.

3. A post-processing apparatus according to claim 1, wherein the post-processing includes a processing of aligning the sheet in a direction perpendicular to a conveying direction of the sheet.

4. A post-processing apparatus according to claim 3, further comprising:

a process tray provided on a side of a terminal end in the conveyance path of the sheet conveying unit; and a pair of alignment members provided in a vicinity of the process tray, wherein the pair of alignment members are configured to align the sheet in the post-processing.

5. A post-processing apparatus according to claim 4, wherein an interval between the pair of alignment members in a waiting state in the first post-processing mode is smaller than an interval between the pair of alignment members in a waiting state in the second post-processing mode.

6. A post-processing apparatus according to claim 3, further comprising a shift unit provided in the conveyance path of the sheet conveying unit, wherein, in the first post-processing mode, the shift unit aligns the sheet in the post-processing.

7. A post-processing apparatus according to claim 1, wherein when the sheet is conveyed in the sheet conveying unit, a sheet interval time in the first post-processing mode is set shorter than a sheet interval time in the second post-processing mode.

8. A post-processing apparatus according to claim 1, wherein a stapling process is performed in the post-processing.

9. A post-processing apparatus according to claim 1, wherein the sheet of the first type includes a normal sheet, and the sheet of the second type includes a transparent sheet.

10. A post-processing apparatus according to claim 1, wherein the sheet detecting unit includes a light reflective sensor and a light transmissive sensor.

11. A post-processing apparatus according to claim 10, wherein whether the sheet of the third type is detectable by the sheet detecting unit is determined based on a detection output of the light transmissive sensor.

12. A post-processing apparatus according to claim 11, wherein it is determined that the sheet of the third type is undetectable by the sheet detecting unit when the detection output of the light transmissive sensor fails to be obtained within a fixed period of time.

13. A post-processing apparatus according to claim 1, wherein in a case in which the sheet of the third type is included in a first copy of sheets of the job, the post-processing apparatus performs the post-processing on the sheet of the third type in the first post-processing mode irrespective of information relating to a light transmittance of the sheet of the third type.

14. A post-processing apparatus according to claim 1, wherein whether the sheet of the third type is detectable by the sheet detecting unit is determined based on sheet information in which a sheet type of the sheet is recorded.

15. A post-processing apparatus according to claim 14, wherein the sheet detecting unit includes a light reflective sensor and a light transmissive sensor, and wherein whether the sheet of the third type is detectable by the sheet detecting unit, which has been determined based on the sheet information, is updated based on a detection output of the light transmissive sensor.

16. A control method for a post-processing apparatus to be connected to an image forming apparatus, the post-processing apparatus including a sheet conveying unit configured to convey a sheet received from the image forming apparatus, a sheet detecting unit, which is arranged in a conveyance path of the sheet conveying unit, and is configured to detect the sheet, and a post-processing unit configured to perform a post-processing on the sheet conveyed by the sheet conveying unit, the control method comprising:

performing the post-processing on a sheet of a first type in a first post-processing mode;

performing the post-processing on a sheet of a second type having a light transmittance higher than a light transmittance of the sheet of the first type in a second post-processing mode, which is different from the first post-processing mode in conveyance control of the sheet conveying unit; and in a case in which a job for performing the post-processing on a sheet of a third type different in type from the sheet of the first type and the sheet of the second type is executed, causing the post-processing apparatus to operate in the second post-processing mode until it is determined whether the sheet of the third type is detectable by the sheet detecting unit, causing the post-processing apparatus to operate in the first post-processing mode when it is determined that the sheet of the third type is detectable by the sheet detecting unit, and causing the post-processing apparatus to operate in the second post-processing mode when it is determined that the sheet of the third type is undetectable by the sheet detecting unit.

17. A non-transitory computer-readable storage medium which stores a program which makes a computer execute the control method as recited in claim 16.

* * * * *